US005659871A

United States Patent [19]

Fujimoto et al.

[11] Patent Number: 5,659,871

[45] Date of Patent: Aug. 19, 1997

[54] PRINTER HAVING DELIVERY ARRANGEMENT IMPARTING TENSION TO PAPER

[75] Inventors: Kenzo Fujimoto; Makoto Maki, both of Hyogo, Japan

[73] Assignee: Fujitsu Limited, Kawasaki, Japan

[21] Appl. No.: 494,001

[22] Filed: Jun. 23, 1995

[30] Foreign Application Priority Data

Jul. 11, 1994 [JP] Japan ..... 6-158481

[51] Int. Cl.[6] ..... G03G 15/00

[52] U.S. Cl. ..... 399/384

[58] Field of Search ..... 355/200, 208, 355/210, 271, 308, 309, 316; 399/16, 92, 361, 381, 384, 396, 397, 400

[56] References Cited

U.S. PATENT DOCUMENTS 4,110,027 8/1978 Sato et al. .
4,943,863 7/1990 Ainoya .
5,296,906 3/1994 Hano et al. .
5,305,068 4/1994 Sato et al. .
5,481,352 1/1996 Yamamoto et al. .

FOREIGN PATENT DOCUMENTS 58-35567 3/1983 Japan .
64-44475 2/1989 Japan .

*Primary Examiner*—Sandra L. Brase
*Attorney, Agent, or Firm*—Armstrong, Westerman, Hattori, McLeland & Naughton

[57] ABSTRACT

A toner image carrying member is disposed beside the substantially mid-point of a delivery path for continuous paper. A first delivery device and second delivery device are disposed upstream and downstream of the toner image carrying member in a delivery direction of the continuous paper, respectively. The delivery speed of the second delivery device in the delivery direction is controlled to be greater than the delivery speed of the first delivery device, thereby imparting tension to the continuous paper.

6 Claims, 20 Drawing Sheets

PRINTER HAVING DELIVERY ARRANGEMENT IMPARTING TENSION TO PAPER

BACKGROUND OF THE INVENTION

1. Field of the Invention

The present invention relates to a printer and, more particularly, to a printer using continuous paper such as a laser printer provided with a photosensitive drum.

2. Description of the Prior Art

FIG. 20 shows a conventional laser printer in which a charger 41, exposing device 42, developing device 43, transfer device 44 and cleaner 45 are aligned around a photosensitive drum 40 in this order in the rotating direction a of the drum 40 so as to face the drum 40 and the transfer device 44 is located under the drum 40. There is provided, between a hopper 46 and stacker 47, a substantially linear delivery path 49 through which continuous paper 48 is delivered. The photosensitive drum 40 is located above the mid-point of the delivery path 49 while the transfer device 44 is located under the delivery path 49 such that the transfer device 44 faces the photosensitive drum 40 with the delivery path 49 between. On the upstream side in the delivery direction with respect to the photosensitive drum 40 in a direction b in which the continuous paper 48 is delivered in the delivery path 49, a tractor 50 and paper guide 51 are arranged in this order in the delivery direction b. On the downstream side of the photosensitive drum 40 in the delivery direction b of the continuous paper 48, a suction delivery device 52, fixing device 53 and scuff rollers 54 are arranged in this order in the delivery direction b.

The suction delivery device 52 is controlled to deliver the continuous paper 48, imparting tension to the continuous paper 48 so that deflection of the continuous paper 48 between the suction delivery device 52 and tractor 50 can be prevented, thereby preventing deterioration of printing quality. The scuff rollers 54 for delivering the continuous paper 48 in the delivery direction b stops paper delivery just after the tractor 50 which delivers the continuous paper 48 is stopped and starts paper delivery just before the tractor 50 is actuated.

SUMMARY OF THE INVENTION

Such a conventional printer, however, presents the drawback that the provision of the suction delivery device 52 for imparting tension to the continuous paper 48 prolongs the delivery path 49 for the continuous paper 48, which is an obstacle to miniaturization of the printer.

The invention has been made in view of this problem, and one of the objects of the invention is therefore to provide a small-sized, low-cost printer which is capable of preventing deterioration of printing quality due to deflection of continuous paper without the use of a suction delivery device.

The above object can be achieved by a printer according to a first aspect of the invention, the printer comprising:

(a) toner image carrying means capable of carrying a toner image formed from electrically charged toner, disposed beside the substantially mid-point of a delivery path for continuous paper;

(b) first delivery means for delivering the continuous paper such that slippage of the continuous paper with respect to the delivery speed of the first delivery means cannot occur when the continuous paper is delivered in a delivery direction, the means being disposed on the upstream side in the delivery direction with respect to the toner image carrying means which is disposed beside the substantially mid-point of the delivery path;

(c) second delivery means for delivering the continuous paper such that slippage of the continuous paper with respect to the delivery speed of the second delivery means can occur when the continuous paper is delivered in the delivery direction, the means being disposed on the downstream side in the delivery direction with respect to the toner image carrying means which is disposed beside the substantially mid-point of the delivery path;

(d) transfer means for transferring the toner image carried by the toner image carrying means onto the continuous paper, disposed so as to face the toner image carrying means with the delivery path between; and (e) paper delivery control means for controlling the delivery speeds of the first delivery means and the second delivery means such that the delivery speed of the second delivery means in the delivery direction is greater than the delivery speed of the first delivery means in the delivery direction which includes zero, whereby tension is imparted to the continuous paper between the first and second delivery means.

In the above arrangement, the first delivery means disposed on the upstream in the delivery direction of the continuous paper with respect to the toner image carrying means which is disposed beside the substantially mid-point of the delivery path, and the second delivery means disposed on the downstream side in the delivery direction of the continuous paper with respect to the toner image carrying means are controlled such that the delivery speed of the second delivery means in the delivery direction is greater than that of the first delivery means, whereby tension is imparted to the continuous paper. With this arrangement, deterioration of printing quality caused by deflection of the continuous paper can be prevented even though a suction delivery device is not used. Since there is no need to use a suction delivery device, a small-sized, low-cost printer can be achieved.

The printer may include fixing means for fixing the toner image which has been transferred from the toner image carrying means onto the continuous paper by the transfer means. Such fixing means is disposed between the toner image carrying means disposed beside the substantially mid-point of the delivery path and the second delivery means.

For making the delivery speed of the second delivery means in the delivery direction greater than that of the first delivery means in order to impart tension to the continuous paper, the paper delivery control means performs control in the following way:

1. The transfer means is movable between a position close to the toner image carrying means where the toner image carried by the toner image carrying means is transferred onto the continuous paper and a position remote from the toner image carrying means. When the delivery speed of the first delivery means is zero and the transfer means is initially operated to move between the close position and remote position in relation to the toner image carrying means, for example, at the time of error reset or turn-on of the power source, the delivery speed of the second delivery means is controlled to exceed zero in order to eliminate deflection of the continuous paper caused by the movement of the transfer means.

2. The transfer means is movable between a position close to the toner image carrying means where the toner image carried by the toner image carrying means is transferred onto the continuous paper and a position remote from the toner image carrying means. When the delivery speed of the first delivery means exceeds zero and the transfer means moves from the close position to the remote position in relation to the toner image carrying means, that is, when the continuous paper is being delivered without the toner image being transferred, control is performed as to increase the delivery speed of the second delivery means being greater than the delivery speed of the first delivery means so that the relative speed difference between the first and second delivery means increases, in order to eliminate deflection of the continuous paper caused by the movement of the transfer means.

3. When the delivery speed of the first delivery means is zero and the smoke removal blower provided in the fixing means is in operation, the delivery speed of the second delivery means is controlled to exceed zero, in order to eliminate deflection of the continuous paper caused by suction by the smoke removal blower.

4. The toner image carrying means (for example, a photosensitive drum) rotates in such a direction that the carried toner image is transferred onto the continuous paper being delivered in the delivery direction in the delivery path. When the toner image carrying means is in its warming-up state during which the delivery speed of the first delivery means is zero while the toner image carrying means rotates, the delivery speed of the second delivery means is controlled to exceed zero in order to eliminate deflection of the continuous paper due to electrostatic attraction caused by the toner image carrying means.

Preferably, the delivery path for the continuous paper between the first and second delivery means, which includes at least the positions of these delivery means, is angled such that the vertex area of the angled delivery path is positioned under the toner image carrying means (for example, photosensitive drum) and in the vicinity of the transfer means which is disposed so as to face the toner image carrying means with the delivery path between. This further reduces the size of the printer.

In cases where the transfer means is movable between the close position and remote position in relation to the toner image carrying means, the printer further comprises position detector means for detecting the transfer means when it is at the close position in relation to the toner image carrying means. For positioning the transfer means at the remote position in relation to the toner image carrying means, the transfer means may be firstly moved to the close position and detected by the position detector means, and then moved back to the remote position with respect to the toner image carrying means. This reduces the number of position detector means required for positional detection and therefore leads to cost reduction.

Fluttering of the trail end of the continuous paper can be prevented by a printer according to a second aspect of the invention, the printer comprising:

(a) toner image carrying means which is disposed beside the substantially mid-point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery means for delivering the continuous paper toward the toner image carrying means, disposed on the upstream side in the delivery direction with respect to the toner image carrying means which is disposed beside the substantially mid-point of the delivery path;

(c) second delivery means for delivering the continuous paper from the toner image carrying means, disposed on the downstream side in the delivery direction with respect to the toner image carrying means which is disposed beside the substantially mid-point of the delivery path;

(d) transfer means which is disposed so as to face the toner image carrying means with the delivery path between, and which is movable between a position close to the toner image carrying means where the toner image carried by the toner image carrying means is transferred onto the continuous paper and a position remote from the toner image carrying means; and (e) paper delivery control means for controlling the toner image carrying means to start rotation and the transfer means to be positioned at the close position in relation to the toner image carrying means, by the time the trail end of the continuous paper has been delivered by the first delivery means at the latest.

Preferably, paper trail end detector means for detecting the trail end of the continuous paper is provided on the upstream side of the first delivery means in the delivery direction for the continuous paper. It is preferable that upon detection of the trail end of the continuous paper by the paper trail end detector means, the paper delivery control means controls the toner image carrying means to start rotation and positions the transfer means at the close position in relation to the toner image carrying means.

Delivery of the continuous paper at the time of automatic loading can be facilitated by a printer according to a third aspect of the invention, the printer comprising:

(a) toner image carrying means which is disposed beside the substantially mid-point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery means for delivering the continuous paper toward the toner image carrying means, disposed on the upstream side in the delivery direction with respect to the toner image carrying means which is disposed beside the substantially mid-point of the delivery path;

(c) second delivery means for delivering the continuous paper from the toner image carrying means, disposed on the downstream side in the delivery direction with respect to the toner image carrying means which is disposed beside the substantially mid-point of the delivery path;

(d) transfer means for transferring the toner image carried by the toner image carrying means onto the continuous paper, disposed so as to face the toner image carrying means with the delivery path between; and (e) paper delivery control means for controlling the toner image carrying means to start rotation by the time the leading end of the continuous paper has been delivered by the first delivery means and has reached the toner image carrying means at the latest, wherein the delivery path including at least the positions of the first and second delivery means and running between the first and second delivery means is angled such that the vertex area of the angled delivery path is positioned under the toner image carrying means and in the vicinity of the transfer means which is disposed so as to face the toner image carrying means with the delivery path between.

It is preferable that the transfer means be movable between a close position close to the toner image carrying means and a remote position remote from the toner image carrying means and that the paper delivery control means controls the transfer means to be positioned at the remote position in relation to the toner image carrying means, by the time the leading end of the continuous paper has reached the toner image carrying means at the latest.

A printer according to the fourth aspect of the invention eliminates deflection of continuous paper in a case where the continuous paper bearing the unfixed toner image is delivered in the delivery direction again after having been once delivered by a specified distance in a direction opposite to the delivery direction upon completion of printing with the aim to shorten the distance between the position where the toner image is transferred onto the continuous paper and the position where the continuous paper is cut. Such a printer comprises:

(a) toner image carrying means which is disposed beside the substantially mid-point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery means for delivering the continuous paper such that slippage of the continuous paper with respect to the delivery speed of the first delivery means cannot occur when the continuous paper is delivered in the delivery direction, the means being disposed on the upstream side in the delivery direction with respect to the toner image carrying means which is disposed beside the substantially mid-point of the delivery path;

(c) second delivery means for delivering the continuous paper such that slippage of the continuous paper with respect to the delivery speed of the second delivery means can occur when the continuous paper is delivered in the delivery direction, the means being disposed on the downstream side in the delivery direction with respect to the toner image carrying means which is disposed beside the substantially mid-point of the delivery path;

(d) transfer means which is disposed so as to face the toner image carrying means with the delivery path between and which is movable between a position close to the toner image carrying means where the toner image carried by the toner image carrying means is transferred onto the continuous paper and a position remote from the toner image carrying means;

(e) fixing means for fixing the toner image which has been transferred onto the continuous paper from the toner image carrying means by the transfer means, disposed between the second delivery means and the toner image carrying means disposed beside the substantially mid-point of the delivery path; and (f) paper delivery control means for controlling the delivery speeds of the first delivery means and the second delivery means so as to cause a relative speed difference between the first and second delivery means thereby to impart tension to the continuous paper between the first and second delivery means; and for controlling the transfer means to be positioned at the close position in relation to the rotating toner image carrying means, between the time when the unfixed toner image has passed the toner image carrying means and the time when the unfixed toner image has reached the fixing means, during which time the continuous paper, which bears the unfixed toner image and has been once delivered by a specified distance in a direction opposite to the delivery direction with the transfer means positioned at the remote position with respect to the toner image carrying means, upon completion of printing, is again delivered in the delivery direction.

In cases where the continuous paper is cut, it is preferable that the paper delivery control means controls the transfer means to be positioned at the close position in relation to the rotating toner image carrying means, when the trail end of the continuous paper is delivered by the first delivery means.

The first delivery means may be a tractor having engagement pins which are brought into engagement with feed holes provided in the continuous paper. The second delivery means may be scuff rollers.

Other objects of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 is a diagrammatic view of the whole construction of the printer;

FIG. 2 is an enlarged view showing the structure of an electrophotographic unit;

FIG. 3 is a diagram illustrating the pivotal movement of a transfer device;

FIG. 4 is a schematic block diagram of a control unit;

FIG. 5 is a flow chart of a main routine;

FIGS. 6 to 11 are flow charts of sub-routines, namely, a transfer device initial operation process routine, printing start process routine, automatic loading process routine, printing stop process routine, smoke removal blower operation process routine and paper discharge process routine;

FIGS. 12 to 14, FIG. 16, 18 and 19 are time charts of transfer device initial operation process, printing start process, automatic loading process, printing stop process, smoke removal blower operation process and paper discharge process;

FIG. 15 is a diagram illustrating delivery of continuous paper during the automatic loading process;

FIGS. 17(A) and 17(B) are diagrams showing the positional relationship of an unfixed toner image which has been transferred onto the continuous paper in the printing stop process and in the paper discharge process, respectively.

DESCRIPTION OF THE PREFERRED EMBODIMENTS

Referring now to the accompanying drawings, a preferred embodiment of a printer according to the invention will be hereinafter described.

Figure 1:
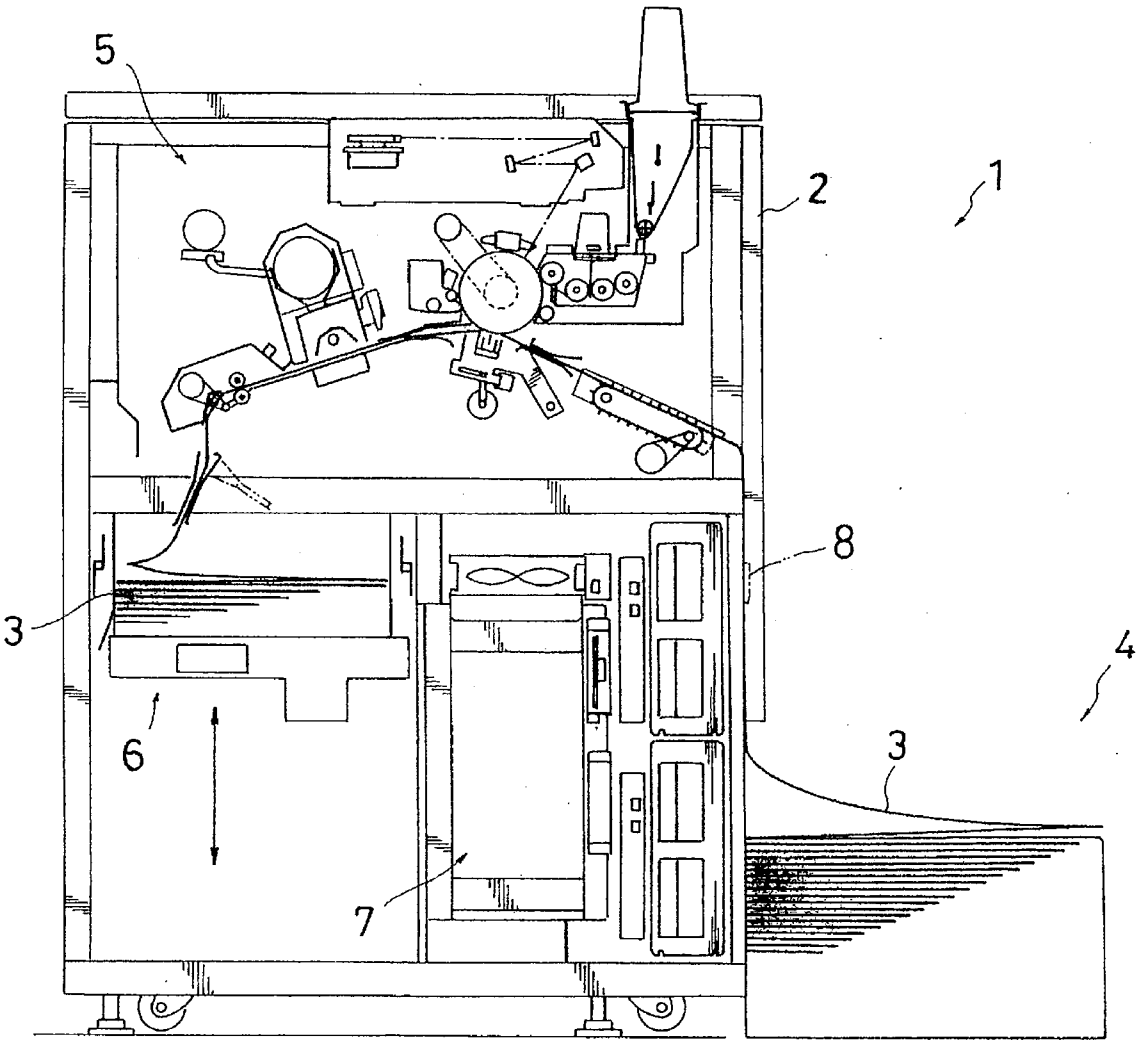
FIGS. 1 to 19 provide illustrations of a printer suitable for carrying out a preferred embodiment of the invention.

FIG. 1 shows a printer 1 according to the embodiment of the invention, in which a hopper unit 4 is installed outside a body frame 2 on the right of the printer 1. In the hopper unit 4, 11-inch continuous paper 3 (in this embodiment) is stored, being folded in such a manner that the front and rear faces of the paper 3 alternately face up. At a lower left position within the body frame 2, a stacker unit 6 is provided for storing the continuous paper 3 on which images have been printed in an electrophotographic unit 5 disposed at an upper position within the body frame 2. In this stacker unit 6, the continuous paper 3 is similarly folded with the front and rear faces facing up alternately. A control unit 7 for controlling the overall function of the printer 1 is provided at a lower right position within the body frame 2. Provided on the right side of the body frame 2 is a photoelectric-type paper end detection sensor 8 for detecting the leading and trail ends of the continuous paper 3 which is delivered from the hopper unit 4 to the stacker unit 6 through the electrophotographic unit 5.

Figure 2:
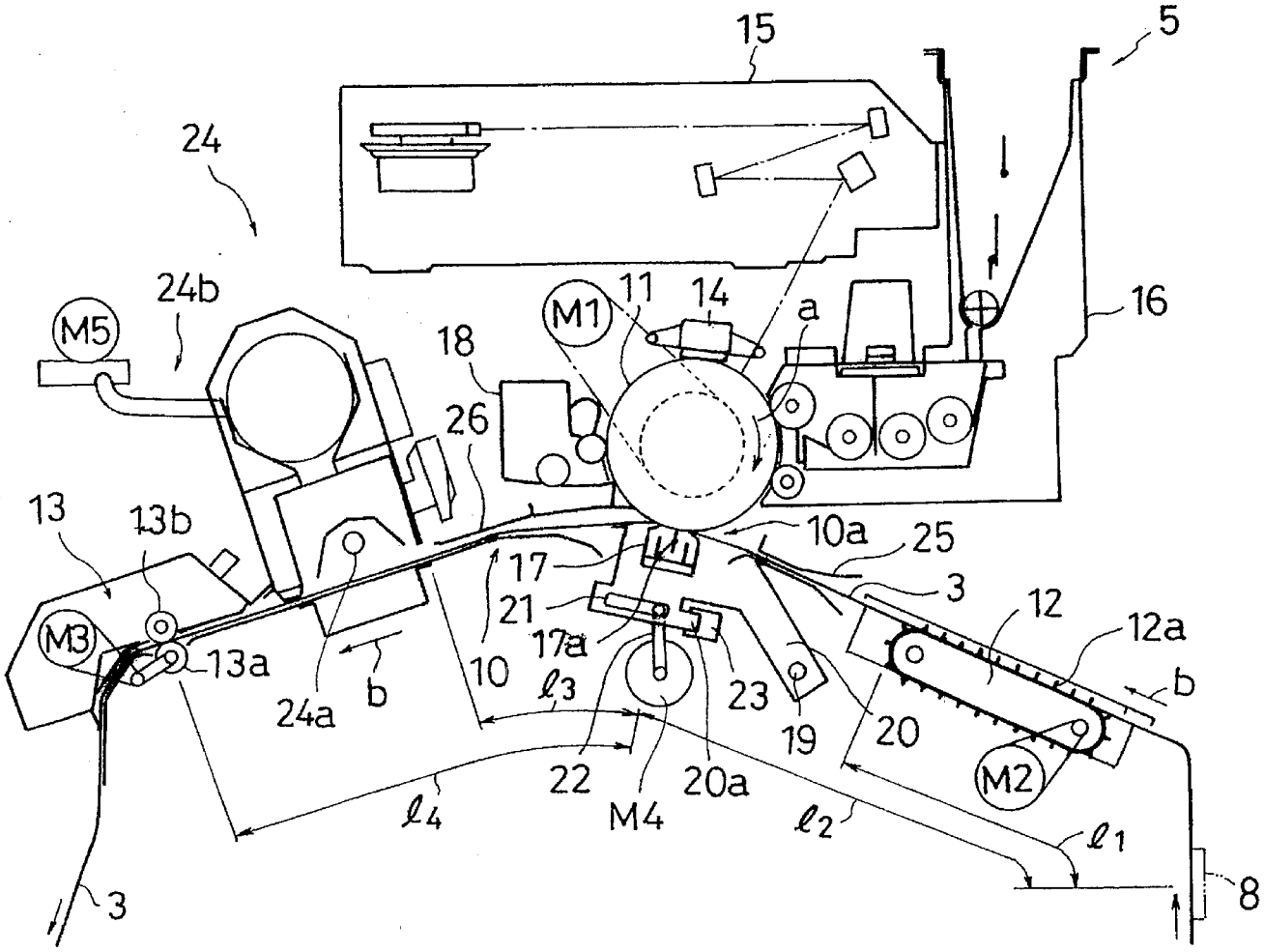

Next, the electrophotographic unit 5 will be described with reference to FIG. 2.

There is provided a delivery path 10 for the continuous paper 3 which is delivered from the hopper unit 4 to the stacker unit 6 through the electrophotographic unit 5. The delivery path 10 is angled and a vertex area 10*a* is located in the substantially middle of the angled delivery path 10. Disposed above the vertex area 10*a* is a photosensitive drum 11 of 80 mm in diameter in this embodiment which has a photosensitive layer on the periphery of a cylindrical body made of, for example, aluminum (Al). The photosensitive layer is formed from a photo-conductive material such as OPC. The photosensitive drum 11 is rotated by a driving motor M1 in a rotating direction a shown in FIG. 2.

On the upstream side of the photosensitive drum 11 in a direction b (see FIG. 2) in which the continuous paper 3 is delivered in the delivery path 10, there is provided a tractor 12 for delivering the continuous paper 3 in the delivery direction b and in the reverse direction according to the forward or reverse rotation of a driving motor M2. The tractor 12 has engagement pins 12*a* which are brought into engagement with feed holes provided at both sides of the continuous paper 3 during delivery of the continuous paper 3 so that slippage of the continuous paper 3 does no occur with respect to the delivery speed that is dependent on the rotational speed of the driving motor M2. On the downstream side of the photosensitive drum 11 in the delivery direction b of the continuous paper 3, there are provided scuff rollers 13 comprising a delivery roller 13*a* and pinch roller 13*b* which are provided in opposed relationship for holding the continuous paper 3 between. The scuff rollers 13 deliver the continuous paper 3 in the delivery direction b such that slippage of the continuous paper 3 may occur with respect to the delivery speed that is dependent on the rotational speed of a driving motor M3 for rotating the delivery roller 13*a*.

Figure 3:
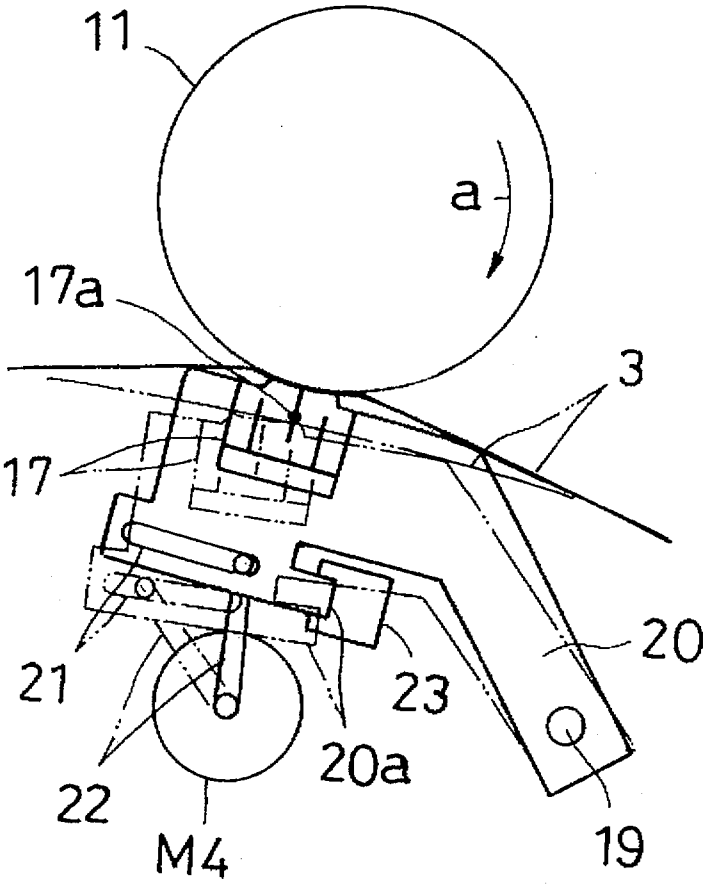

Disposed around the photosensitive drum 11 are (i) a charger 14 for uniformly, electrically charging the surface of the photosensitive drum 11, (ii) an exposing device 15 for directing light to areas other than an image formed on the surface of the photosensitive drum 11 electrically charged by the charger 14, in order to form an electrostatic latent image, (iii) a developing device 16 for forming a visible image by applying toner to the electrostatic latent image formed by the exposing device 15, the toner being opposite to the electrostatic latent image in polarity, (iv) a transfer device 17 for transferring the toner image carried by the photosensitive drum 11 onto the continuous paper 3 with the help of static electricity, by pressing the continuous paper 3 onto the toner image formed on the photosensitive drum 11 by the developing device 16 and then applying polarity opposite to that of the toner from the rear face of the continuous paper 3 by a corona wire 17*a*, and (v) a cleaner 18 for removing residual toner which has not been transferred but remained on the photosensitive drum 11. These members are aligned in the listed order in the rotating direction a so as to face the photosensitive drum 11. The transfer device 17 is located as shown in FIG. 2 under the photosensitive drum 11 so as to face the photosensitive drum 11 with the delivery path 10 between. As shown in FIG. 3, the transfer device 17 is attached to a supporting plate 20 which pivots on a supporting shaft 19. The supporting plate 20 is pivoted on the supporting shaft 19 by pivoting a driving rod 22 engaged with a guide groove 21 formed on the supporting plate 20 by means of a forwardly and reversely rotatable driving motor M4. This allows the transfer device 17 to pivot between a close position indicated by solid line which is close to the photosensitive drum 11 with a clearance of about 0.7 mm (i.e., a transfer position where the continuous paper 3 is overlaid and pressed on the surface of the photosensitive drum 11) and a remote position indicated by two-dot chain line. Accordingly, the transfer device 17 can be positioned at the close position and remote position. When the transfer device 17 is positioned at the close position in relation to the photosensitive drum 11 and a specified current is supplied to the corona wire 17*a* thereby to apply electric charge of opposite polarity to the continuous paper 3 as mentioned earlier, the toner image carried by the photosensitive drum 11 is transferred onto the continuous paper 3. It should be noted that reference numeral 23 denotes a photo-conductive type close position detection sensor which detects the transfer device 17 when it is positioned at the close position in relation to the photosensitive drum 11 by detecting through projection 20*a* of the supporting plate 20.

On the downstream side of the photosensitive drum 11 in the delivery direction b of the delivery path 10 and, more specifically, on the upper side of the delivery path 10 between the photosensitive drum 11 and the scuff rollers 13, there is provided a fixing device 24 for permanently fixing the toner image, which has been transferred onto the continuous paper 3 by the transfer device 17, by heat fusing with the use of a flash lamp 24*a* in this embodiment. The fixing device 24 includes a smoke removal blower 24*b* that is usually operated during printing operation by means of a driving motor M5 to remove smoke and odor generated by heat fusing. Note that reference numerals 25, 26 denote paper guides for guiding the continuous paper 3, which are disposed upstream and downstream with respect to the photosensitive drum 11 in the delivery direction b of the delivery path 10.

In this embodiment, the distance $I_1$ between the detection position for the paper end detection sensor 8 and the downstream end (in the delivery direction b) of the tractor 12 is 455 mm, and the distance $I_2$ between the detection position for the paper end detection sensor 8 and the transfer position for the transfer device 17 is 626 min. The distance $I_3$ between the transfer position for the transfer device 17 and the upstream end (in the delivery direction b) of the fixing device 24 is 167 mm and the distance $I_4$ between the transfer position for the transfer device 17 and the scuff rollers 13 is 330 mm.

Figure 4:
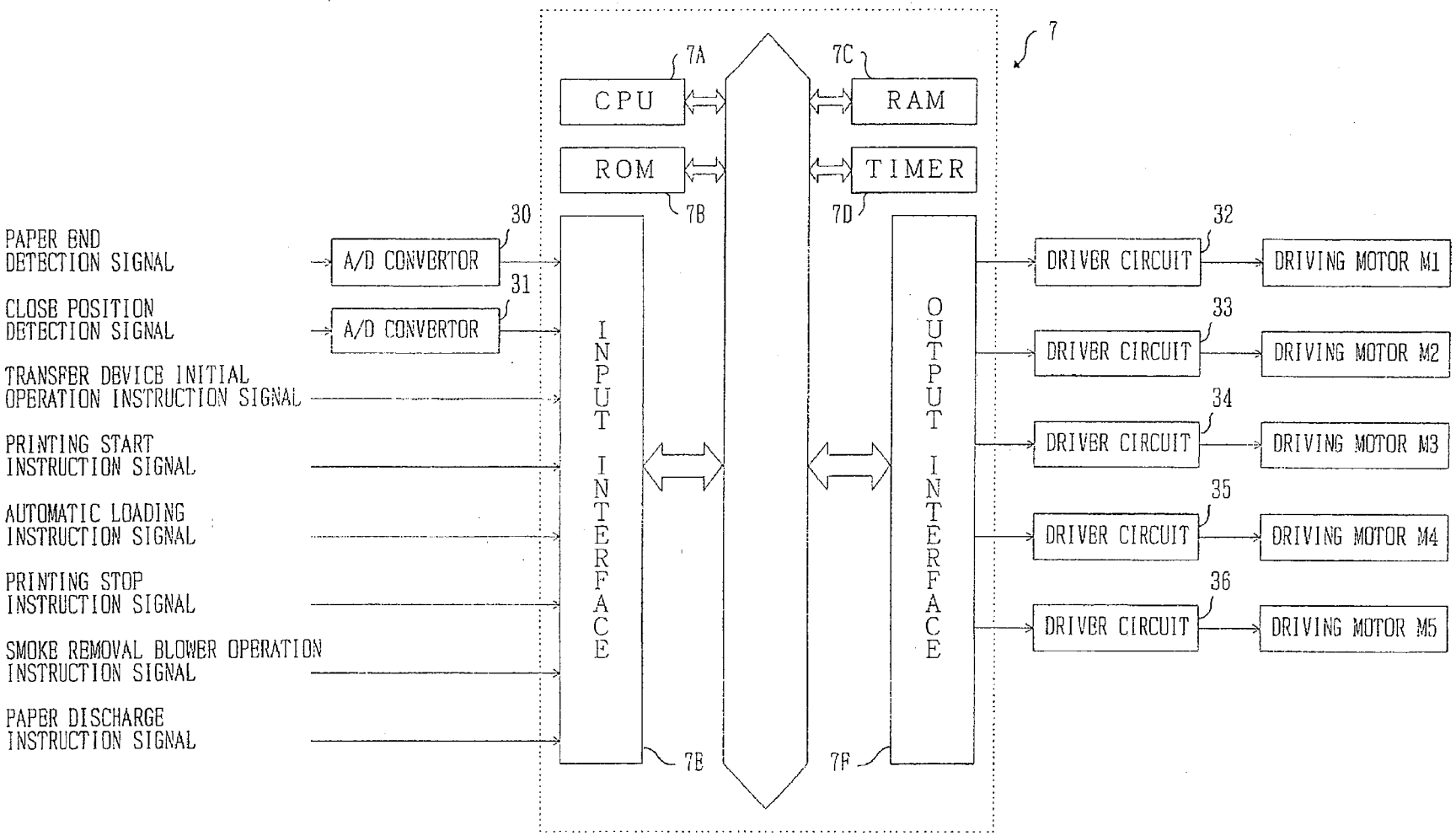

Reference is made to FIG. 4 for schematically describing the control unit 7 for controlling the overall function of the printer 1. In the following description, only the parts directly related to the invention will be explained.

A paper end detection signal is released from the paper end detection sensor 8 to the control unit 7 through an A/D convertor 30 upon detection of the leading or trail end of the continuous paper 3. A close position detection signal is released from the close position detection sensor 23 to the control unit 7 through an A/D convertor 31 upon detection of the transfer device 17 positioned at the close position in relation to the photosensitive drum 11. The following signals are also input to the control unit 7 when their corresponding operation switches on an operation panel (not shown) are operated: (i) a transfer device initial operation instruction signal for starting initial operation to set the transfer device 17 in its initial position at the time of error reset, turn-on of the power source etc.; (ii) a printing start instruction signal for starting printing operation; (iii) an automatic loading instruction signal for starting automatic loading of the continuous paper 3 into the delivery path 10; (iv) a printing stop instruction signal for stopping printing operation; (v) a smoke removal blower operation instruction signal for actuating the smoke removal blower **24*b* of the fixing device 24; and (vi) a paper discharge instruction signal for discharging the continuous paper 3 by turning on the operation switch after the continuous paper 3 has been cut by the operator upon completion of a series of printing operation or without cutting the continuous paper 3** by the operator.

The control unit 7 outputs driving control signals to driver circuits 32 to 36 which respectively drive (i) the driving motor M1 for rotating the photosensitive drum 11 in the rotating direction a; (ii) the driving motor M2 which forwardly or reversely rotates so that the tractor 12 is driven to deliver the continuous paper 3 at specified delivery speeds in the delivery direction b or direction opposite to the delivery direction b; (iii) the driving motor M3 for driving the delivery roller **13*a* of the scuff rollers 13 to deliver the continuous paper 3 in the delivery direction b at specified delivery speeds; (iv) the driving motor M4 for pivoting the transfer device 17 to be positioned at the close position or remote position; and (v) the driving motor M5 for operating the smoke removal blower 24*b* of the fixing device 24**.

The control unit 7 is composed of (i) a central processing unit (CPU) 7A for executing a specified program; (ii) a read-only memory (ROM) 7B for storing the program; (iii) a random access memory (RAM) 7C which serves as a working memory necessary for executing the program and as registers for various functions; (iv) a timer 7D for measuring elapsed time for an event in the program; and (v) input and output interfaces 7E and 7F associated with input and output operations.

Figure 5:
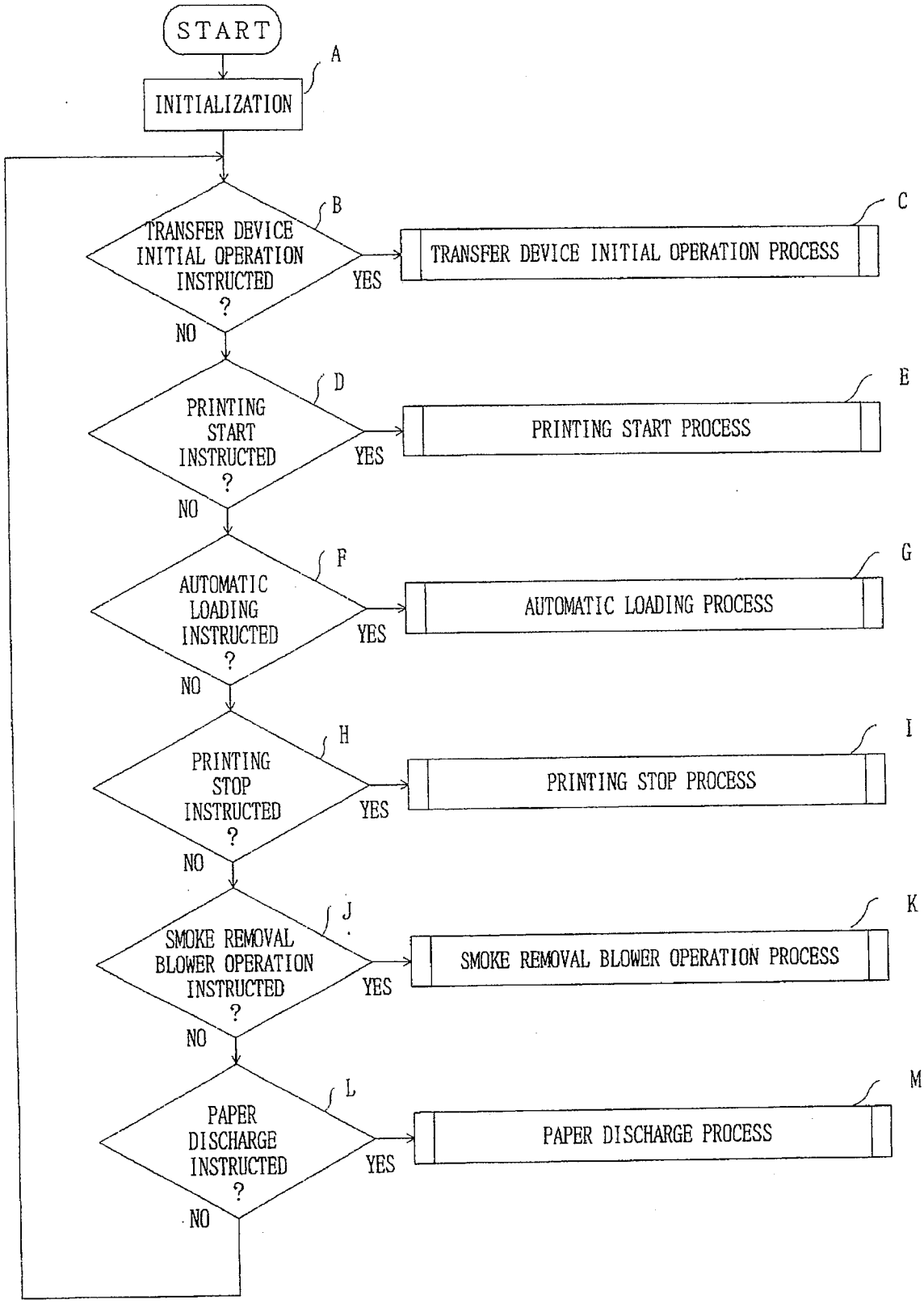

Reference is now made to FIG. 5 which shows the flow chart of the main routine, for describing the basic operation of the printer of the invention having the above construction.

A: The power source is turned on to execute a specified program and the contents of the registers etc. in the RAM 7C are all cleared, thereby performing initialization.

B: A check is made to determine if a transfer device initial operation instruction signal has been input so that initial operation for setting the transfer device 17 at its initial position has been instructed. If so, the program proceeds to the transfer device initial operation process routine in Step C.

C: Transfer device initial operation process routine. The transfer device 17 is firstly pivoted to the close position in relation to the photosensitive drum 11 and then pivoted to the remote position, thereby setting the transfer device 17 at its initial position. Details will be described later with reference to the flow chart of FIG. 6.

D: A check is made to determine if a printing start instruction signal has been input so that starting of printing operation has been instructed. If so, the program proceeds to the printing start process routine in Step E.

E: Printing start process routine. For starting printing operation, the photosensitive drum 11 is heated and rotated while toner in the developing device 16 is agitated, whereby warming-up is carried out. Details will be described later with reference to the flow chart of FIG. 7.

F: A check is made to determine if an automatic loading instruction signal has been input so that automatic loading of the continuous paper 3 into the delivery path 10 has been instructed. If so, the program proceeds to the automatic loading process routine in Step G.

G: Automatic loading process routine. The leading end of the continuous paper 3 is guided and delivered by rotation of the photosensitive drum 11 to carry out loading. Details will be described later with reference to the flow chart of FIG. 8.

H: A check is made to determine if a printing stop signal has been input so that stop of printing operation has been instructed. If so, the program proceeds to the printing stop process routine in Step I.

I: Printing stop process routine. After the trail end of a toner image has been transferred onto the continuous paper 3, the continuous paper 3 is further delivered by ½ inch in the delivery direction b. Thereafter, with the transfer device 17 being pivoted to the remote position, the rotation of the photosensitive drum 11 is stopped and the continuous paper 3 bearing the toner image which has not been fixed but transferred is delivered by 1 inch in the opposite direction to the delivery direction b, whereby the printing stop process is performed. Details will be described later with reference to the flow chart of FIG. 9.

J: A check is made to determine if a smoke removal blower operation instruction signal has been input so that actuation of the smoke removal blower **24*b* of the fixing device 24 has been instructed for removing smoke and odor generated by heat fusing with the flash lamp 24*a***. If so, the program proceeds to the smoke removal blower operation process routine in Step K.

K: Smoke removal blower operation process routine. For actuation of the smoke removal blower **24*b*, the delivery roller 13*a* of the scuff rollers 13 is rotated. After stop of the rotation of the delivery roller 13*a*, the operation of the smoke removal blower 24*b* is stopped. Details will be described later referring to the flow chart of FIG. 10**.

L: A check is made to determine if a paper discharge instruction signal has been input after completion of a series of printing processes so that discharging of the continuous paper 3 has been instructed. If so, the program proceeds to the paper discharge process routine in Step M.

It should be noted that upon completion of a series of printing processes, the printing stop process routine has been executed.

M: Paper discharge process routine. The transfer device 17 in the remote position is pivoted to and positioned at the close position in relation to the photosensitive drum 11 between the time when the unfixed toner image has passed the photosensitive drum 11 and the time when the unfixed toner image has reached the fixing device 24, while the continuous paper 3 is delivered in the delivery direction b, whereby paper discharge is carried out. Details will be described later with reference to the flow chart of FIG. 11.

Next, the transfer device initial operation process routine (Step C), printing start process routine (Step E), automatic loading process routine (Step G), printing stop process routine (Step I), smoke removal blower operation process routine (Step K) and paper discharge process routine (Step M) will be explained in this order.

Obviously, delivery speed and time are not limited to the values mentioned in the following description, as other values can be employed satisfactorily in the invention.

Figure 6:
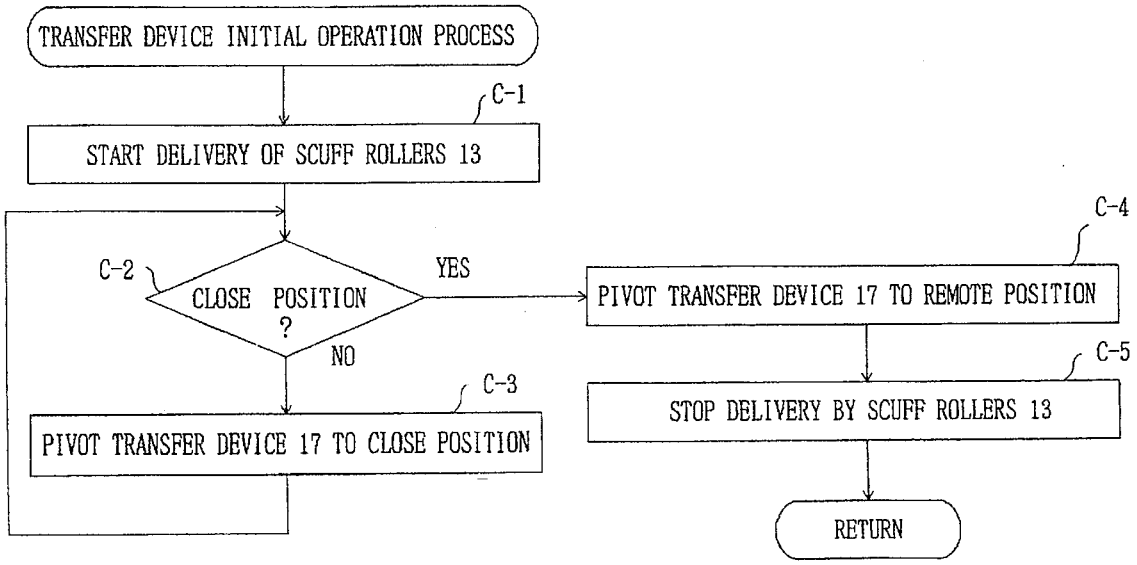
Figure 12:
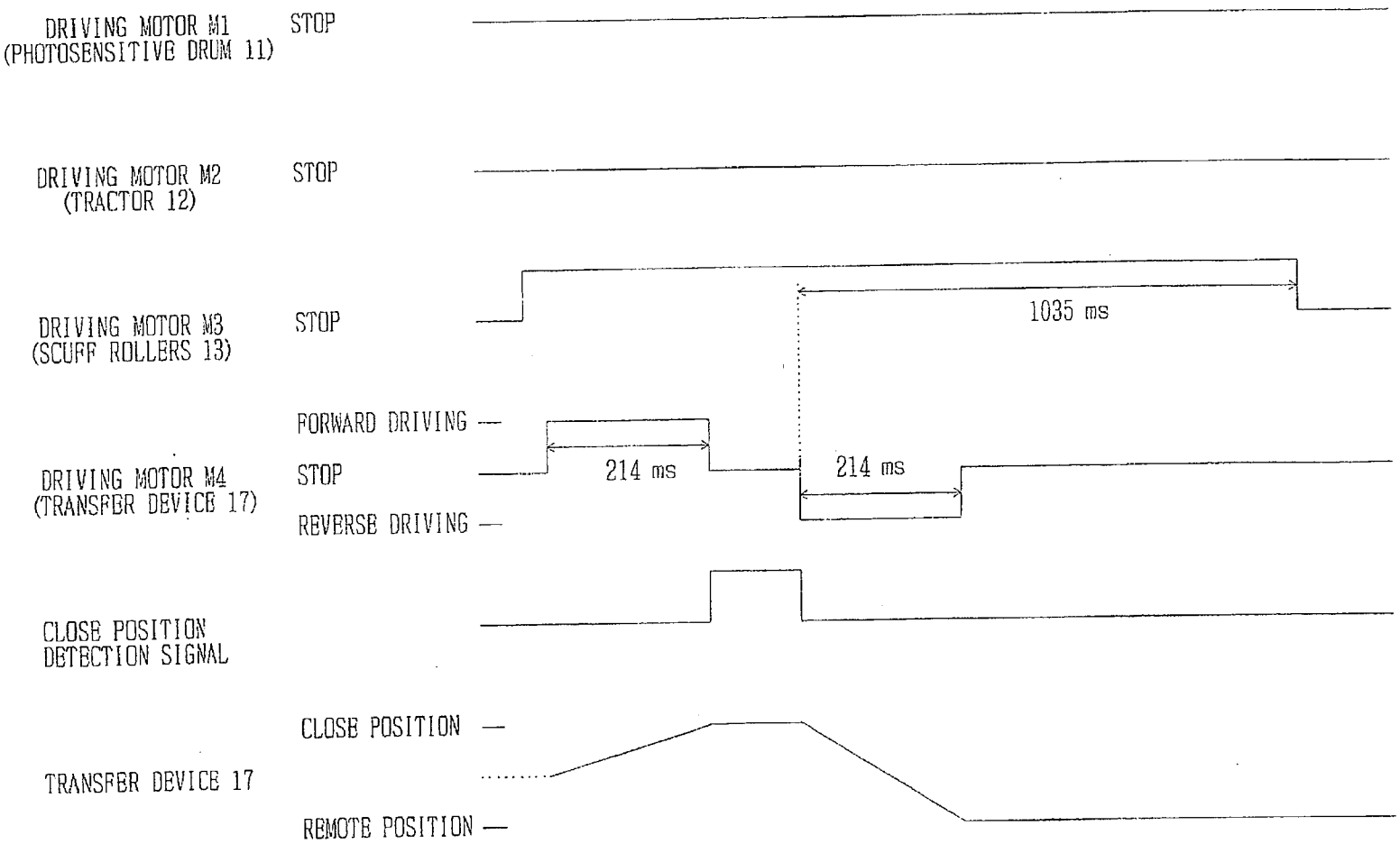

[Transfer device initial operation process routine (Step C)—see FIGS. 6 and 12]

Before starting this routine, the driving motor M1 for rotating the photosensitive drum 11, the driving motor M2 for driving the tractor 12 and the driving motor M3 for rotating the delivery roller 13*a* of the scuff rollers 13 are all stopped.

In such a condition, the driving motor M3 for rotating the delivery roller 13*a* of the scuff rollers 13 is actuated through the driver circuit 34 such that the scuff rollers 13 start to deliver the continuous paper 3 in the delivery direction b at a speed of 89 mm/s (Step C-1). Since the tractor 12 is stopped, the continuous paper 3 is pulled, being in a complete slipping condition, by the scuff rollers 13 which have a delivery speed of 89 mm/s. Thus, tension is imparted to the continuous paper 3, thereby eliminating deflection of the continuous paper 3 between the tractor 12 and scuff rollers 13.

Thereafter, a check is made to determine whether the transfer device 17 is in the close position in relation to the photosensitive drum 11, according to a close position detection signal which has been input through the A/D convertor circuit 31 (Step C-2). If the transfer device 17 is not in the close position but in the remote position, the driving motor M4 for pivoting the transfer device 17 is forwardly driven through the driver circuit 35 between the time when pivoting of the transfer device 17 to the close position has started and the time when the transfer device 17 has been completely pivoted to and positioned at the close position (i.e., 214 ms), so that the transfer device 17 is positioned at the close position in relation to the photosensitive drum 11 (Step C-3). If the transfer device 17 is in the close position, the driving motor M4 for pivoting the transfer device 17 is reversely driven through the driver circuit 35 between the time when pivoting of the transfer device 17 to the remote position has started and the time when the transfer device 17 has been completely pivoted to and positioned at the remote position (i.e., 214 ms), so that the transfer device 17 is positioned at the remote position in relation to the photosensitive drum 11 (Step C-4). After an elapse of 1,035 ms since reverse driving of the driving motor M4 started, that is, after the transfer device 17 has been completely pivoted to and positioned at the remote position, the driving motor M3 for driving the delivery roller 13*a* of the scuff rollers 13 is stopped so that the delivery operation of the scuff rollers 13 is stopped (Step C-5).

In the above process, the continuous paper 3 is being pulled by the scuff rollers 13 until the transfer device 17 has been positioned at its initial position, that is, the remote position in relation to the photosensitive drum 11, so that tension is applied to eliminate deflection of the continuous paper 3 caused by the pivot of the transfer device 17.

Figure 7:
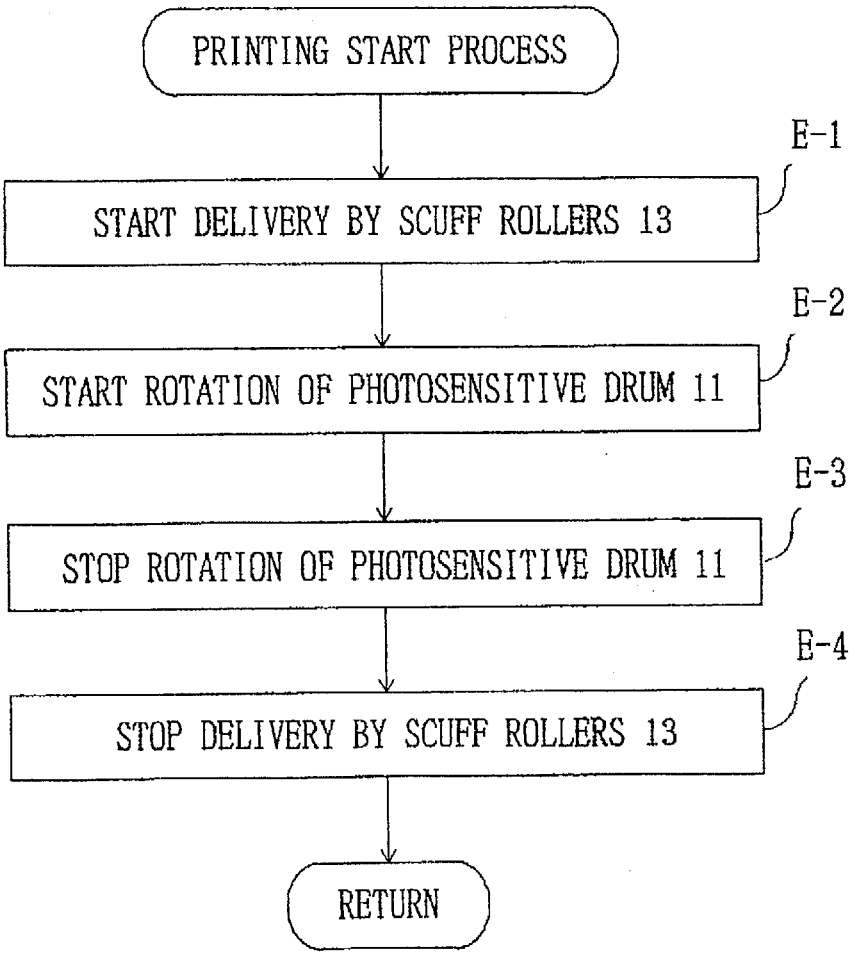
Figure 13:
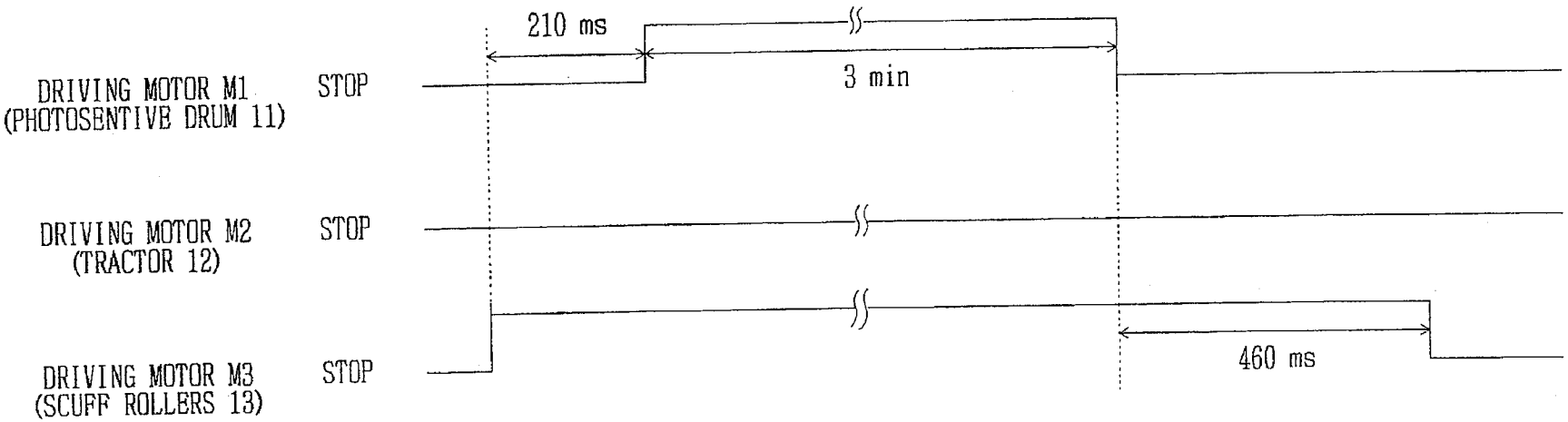

[Printing start process routine (Step E)—see FIGS. 7 and 13]

Before starting this routine, the driving motor M1 for rotating the photosensitive drum 11, the driving motor M2 for driving the tractor 12 and the driving motor M3 for rotating the delivery roller 13*a* of the scuff rollers 13 are all stopped and the transfer device 17 is positioned at the remote position in relation to the photosensitive drum 11.

In such a condition, the driving motor M3 for rotating the delivery roller 13*a* of the scuff rollers 13 is firstly actuated through the driver circuit 34 such that the scuff rollers 13 deliver the continuous paper 3 in the delivery direction b at a speed of 89 mm/s (Step E-1). Since the tractor 12 is stopped, the continuous paper 3 is pulled by the scuff rollers 13 which have a delivery speed of 89 mm/s, so that tension is imparted to the continuous paper 3, thereby eliminating deflection of the continuous paper 3 between the tractor 12 and the scuff rollers 13.

After an elapse of 210 ms since the delivery of the continuous paper 3 by the scuff rollers 13 started, the driving motor M1 is driven through the driver circuit 32 to rotate and heat the photosensitive drum 11 (Step E-2). After an elapse of a preset time (3 min) required for warming-up for printing such as heating of the photosensitive drum 11 and agitation of toner in the developing device 16, the driving motor M1 for rotating the photosensitive drum 11 is stopped, thereby stopping the rotation of the photosensitive drum 11 (Step E-3). After an elapse of 460 ms since the driving motor M1 stopped, the driving motor M3 for rotating the delivery roller 13*a* of the scuff rollers 13 is stopped, thereby stopping the delivery operation of the scuff rollers 13 (Step E-4).

Accordingly, the continuous paper 3 is pulled by the scuff rollers 13 while the photosensitive drum 11 being rotated for warming-up and tension is applied to the continuous paper 3 so that deflection of the continuous paper 3 caused by electrostatic attraction of the photosensitive drum 11 can be eliminated.

Figure 8:
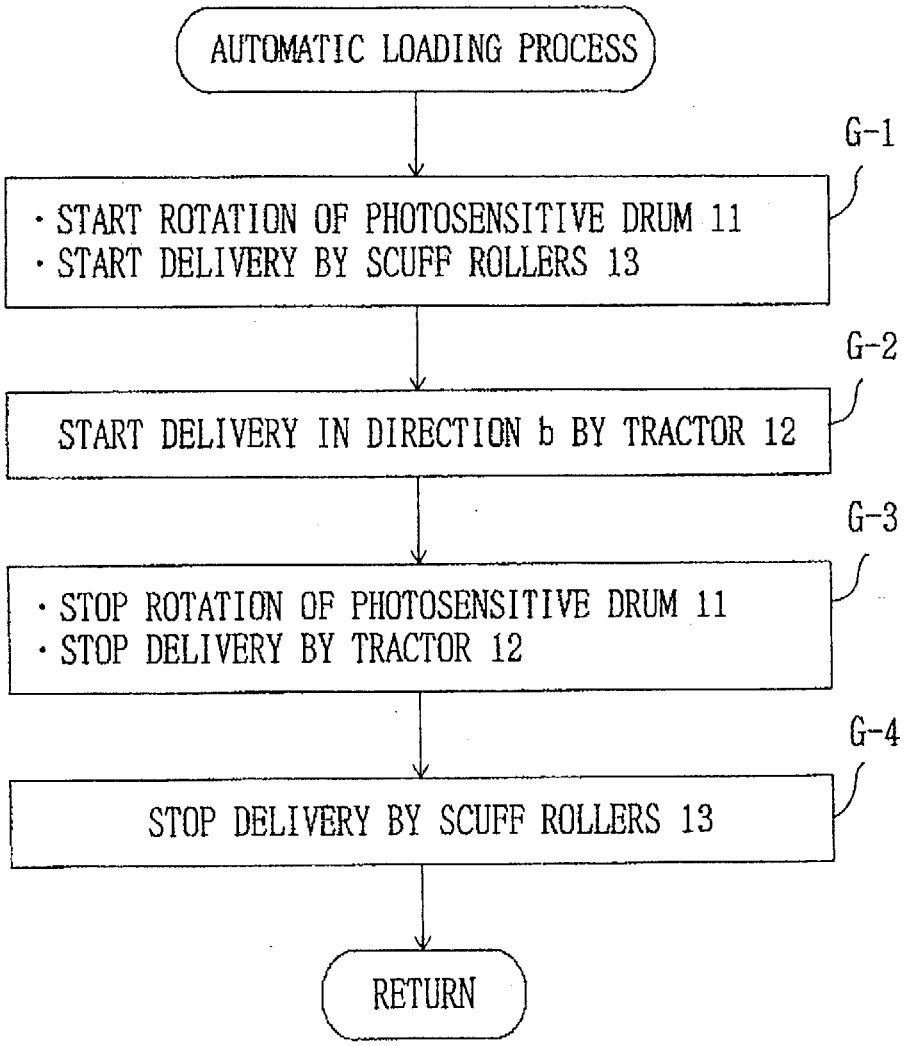
Figure 14:
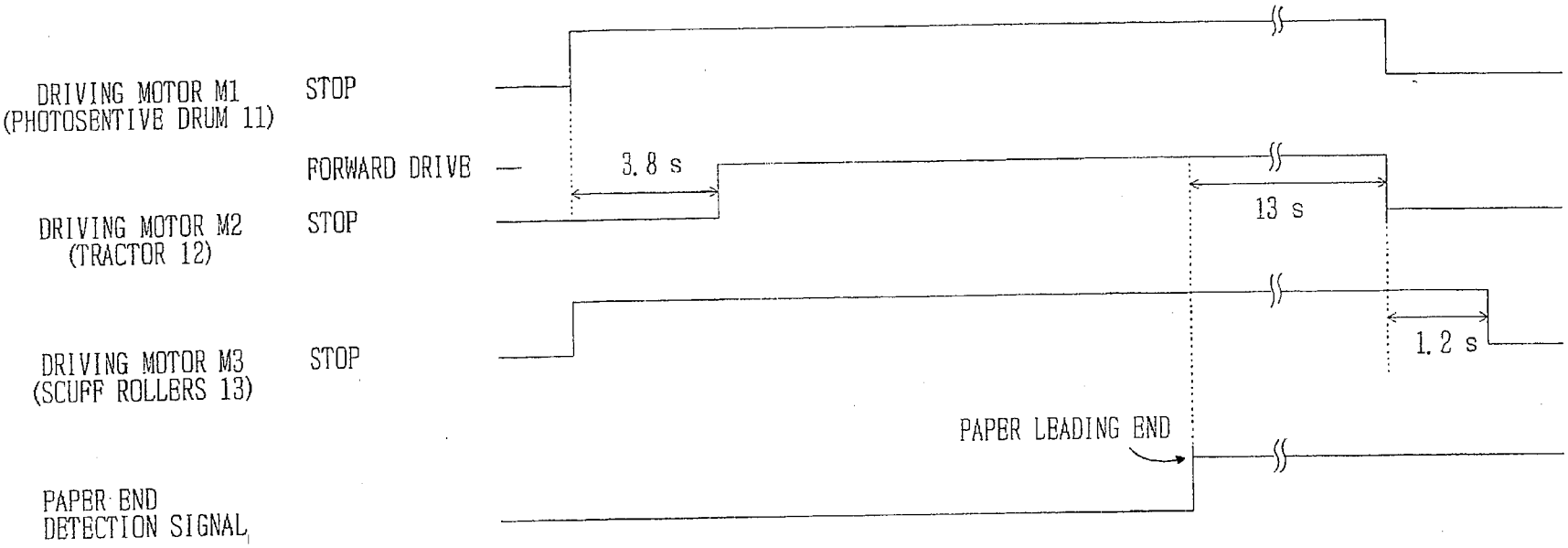

[Automatic loading process routine (Step G)—see FIGS. 8 and 14]

Before starting this routine, the driving motor M1 for rotating the photosensitive drum 11, the driving motor M2 for driving the tractor 12 and the driving motor M3 for rotating the delivery roller 13*a* of the scuff rollers 13 are all stopped and the transfer device 17 is positioned at the remote position in relation to the photosensitive drum 11.

In such a condition, the driving motor M1 for rotating the photosensitive drum 11 is firstly actuated through the driver circuit 32, and the driving motor M3 for rotating the delivery roller 13*a* of the scuff rollers 13 is actuated through the driver circuit 34 such that the scuff rollers 13 deliver the continuous paper 3 in the delivery direction b at a speed of 93 mm/s (Step G-1).

After 3.8 s have elapsed since the start of the rotation of the photosensitive drum 11, the driving motor M2 for driving the tractor 12 is forwardly driven through the driver circuit 33 to deliver the continuous paper 3 in the delivery direction b at a speed of 89 mm/s (Step G-2). After an elapse of a preset time (13 s) required for automatic loading (for automatically loading four sheets of 11-inch paper in this embodiment) since the leading end of the continuous paper 3 was detected based on a paper end detection signal input through the A/D convertor circuit 30, the driving motor M1 is stopped to stop the rotation of the photosensitive drum 11 and the driving motor M2 is stopped to stop the tractor 12 (Step G-3). After an elapse of 1.2 s since the stop of the driving motors M1 and M2, the driving motor M3 for rotating the delivery roller 13*a* of the scuff rollers 13 is stopped thereby stopping the delivery operation of the scuff rollers 13 (Step G-4).

Figure 15:
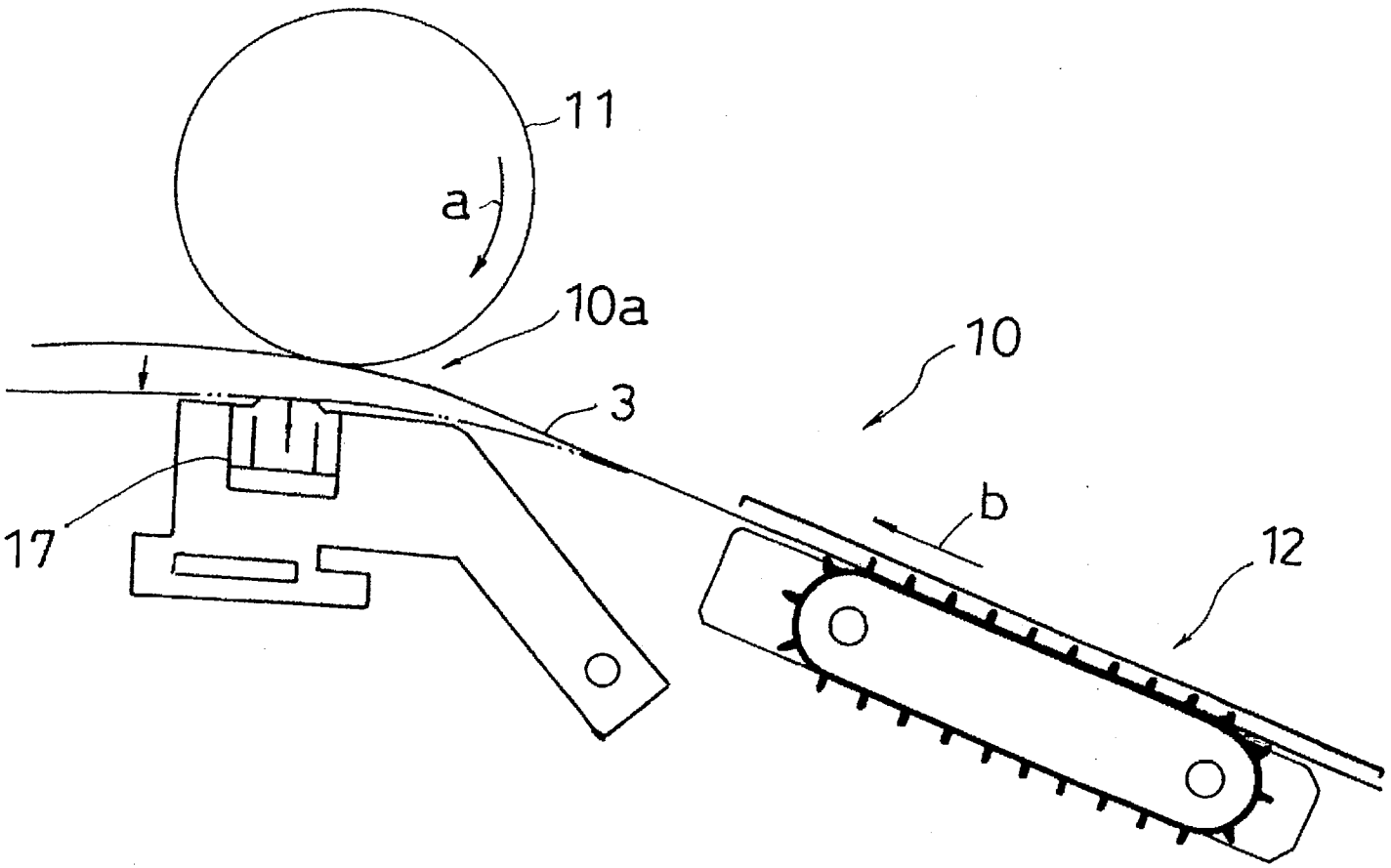

As shown in FIG. 15, the leading end of the continuous paper 3 is delivered toward the vertex area 10*a* in the angled delivery path 10 by the tractor 12 and strikes against the underside of the photosensitive drum 11. Then, the leading end of the continuous paper 3 is guided between the photosensitive drum 11 and the transfer device 17 positioned at the remote position, by the rotation of the photosensitive drum 11 in the rotating direction a. The continuous paper 3 then fails along the angled delivery path 10 because of its own weight and travels toward the scuff rollers 13. Finally, the continuous paper 3 is delivered, being held between the delivery roller 13*a* and pinch roller 13*b* of the scuff rollers 13. In this way, the delivery of the continuous paper 3 is easily carried out during automatic loading of the continuous paper 3 and therefore a paper jam is unlikely to occur.

Figure 9:
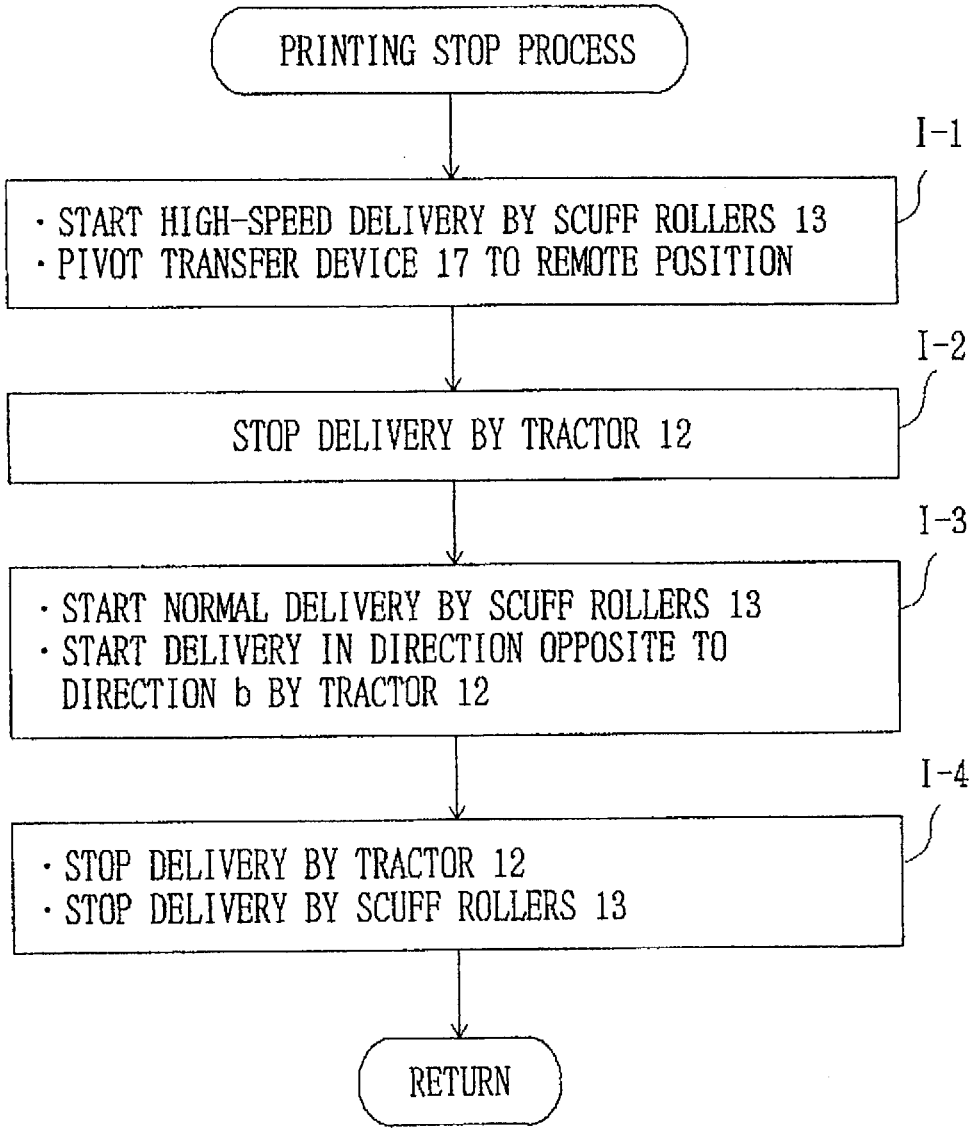
Figure 16:
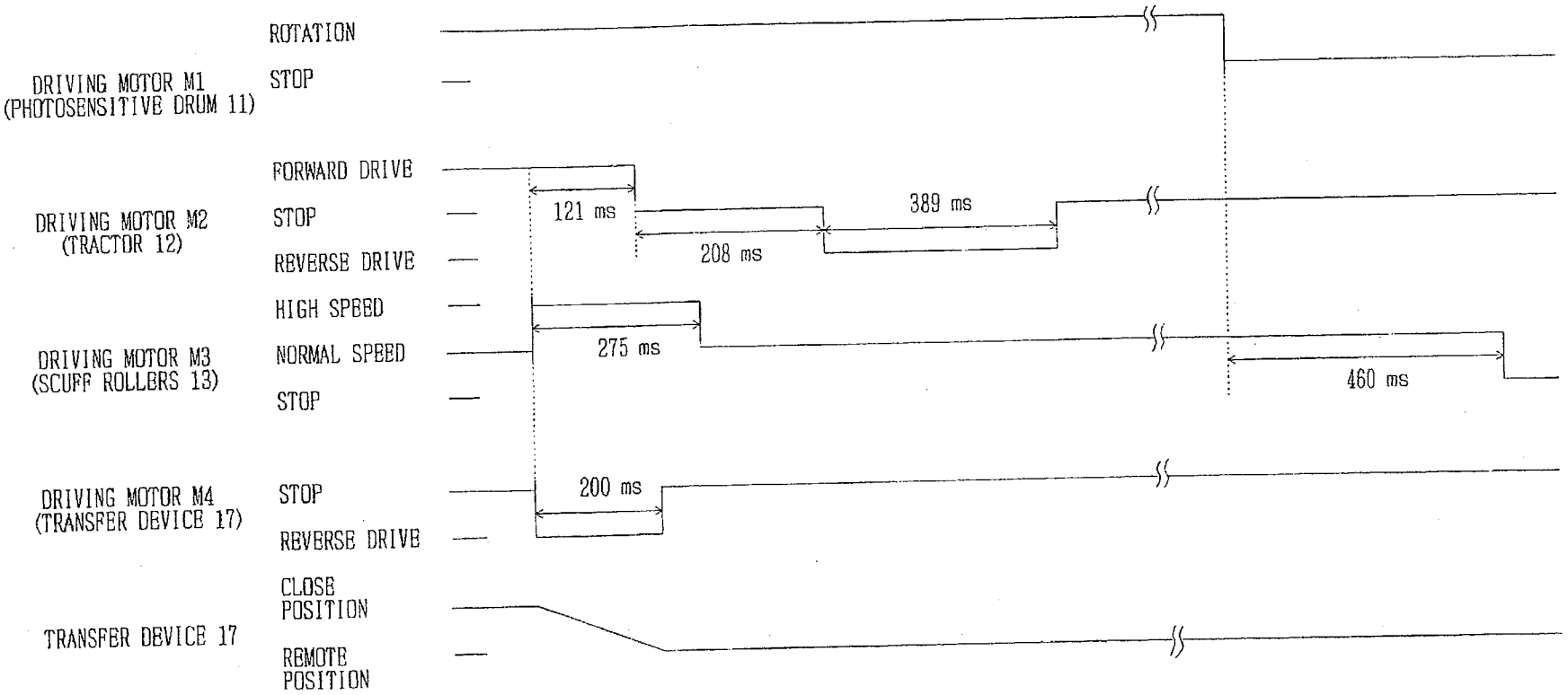

[Printing stop process routine (Step I)—see FIGS. 9 and 16]

Before starting this routine, the driving motor M1 is driven, rotating the photosensitive drum 11 in the rotating direction a; the driving motor M2 is forwardly driven, driving the tractor 12 to deliver the continuous paper 3 in the delivery direction b at a speed of 89 mm/s; the driving motor M3 is driven, rotating the delivery roller 13*a* of the scuff rollers 13 to deliver the continuous paper 3 in the delivery direction b at a normal speed of 93 mm/s; and the transfer device 17 is positioned at the close position.

In such a condition, the driving motor M3 for rotating the delivery roller 13*a* of the scuff rollers 13 is firstly actuated through the driver circuit 34 such that the scuff rollers 13 are brought from the state where the continuous paper 3 is delivered in the delivery direction b at a normal speed of 93 mm/s into the state where the continuous paper 3 is delivered in the delivery direction b at a high speed of 107 mm/s. In the meantime, the driving motor M4 for driving the transfer device 17 is reversely driven through the driver circuit 35 to pivot the transfer device 17 to the remote position in relation to the photosensitive drum 11 (Step I-1). After an elapse of 121 ms since the change of the delivery state of the scuff rollers 13 and the pivot of the transfer device 17 to the remote position started, in other words, after the continuous paper 3 has been delivered by an additional ½ inch in the delivery direction b after transferring of the trail end of the toner image onto the continuous paper 3, the driving motor M2 for driving the tractor 12 is stopped, thereby stopping the delivery of the continuous paper 3. After the transfer device 17 has been completely positioned at the remote position 200 ms after starting the pivot of the transfer device 17 to the remote position, the driving motor M4 for pivoting the transfer device 17 is stopped (Step I-2).

After an elapse of 75 ms since the driving motor M4 for pivoting the transfer device 17 stopped, the driving motor M3 for rotating the delivery roller 13*a* of the scuff rollers 13 is driven through the driver circuit 34 so as to change the delivery speed of the scuff rollers 13 from 107 mm/s (high speed) to 93 mm/s (normal speed) so that the continuous paper 3 is delivered in the direction b at a speed of 93 mm/s. After an elapse of 208 ms since the driving motor M2 for driving the tractor 12 stopped, the driving motor M2 is reversely driven through the driver circuit 33 such that the continuous paper 3 is delivered in the direction opposite to the delivery direction b at a speed of 89 mm/s (Step I-3). Thereafter, the driving motor M2 for driving the tractor 12 is stopped, after an elapse of 389 ms since its reverse driving started, that is, after the continuous paper 3 bearing the transferred, unfixed toner image has been delivered by 1 inch in the opposite direction to the delivery direction b and brought into the state shown in FIG. 17(A)(Step I-4). Following the post treatment time, after an elapse of 460 ms since the driving motor M1 for rotating the photosensitive drum 11 stopped, the driving motor M3 for rotating the delivery roller 13*a* of the scuff rollers 13 is stopped, thereby stopping the delivery operation of the scuff rollers 13 (Step I-5).

If the continuous paper 3 is cut and paper discharge process is performed in the above condition, the distance between the position where the toner image is transferred onto the continuous paper 3 and the cutting position can be reduced.

Figure 10:
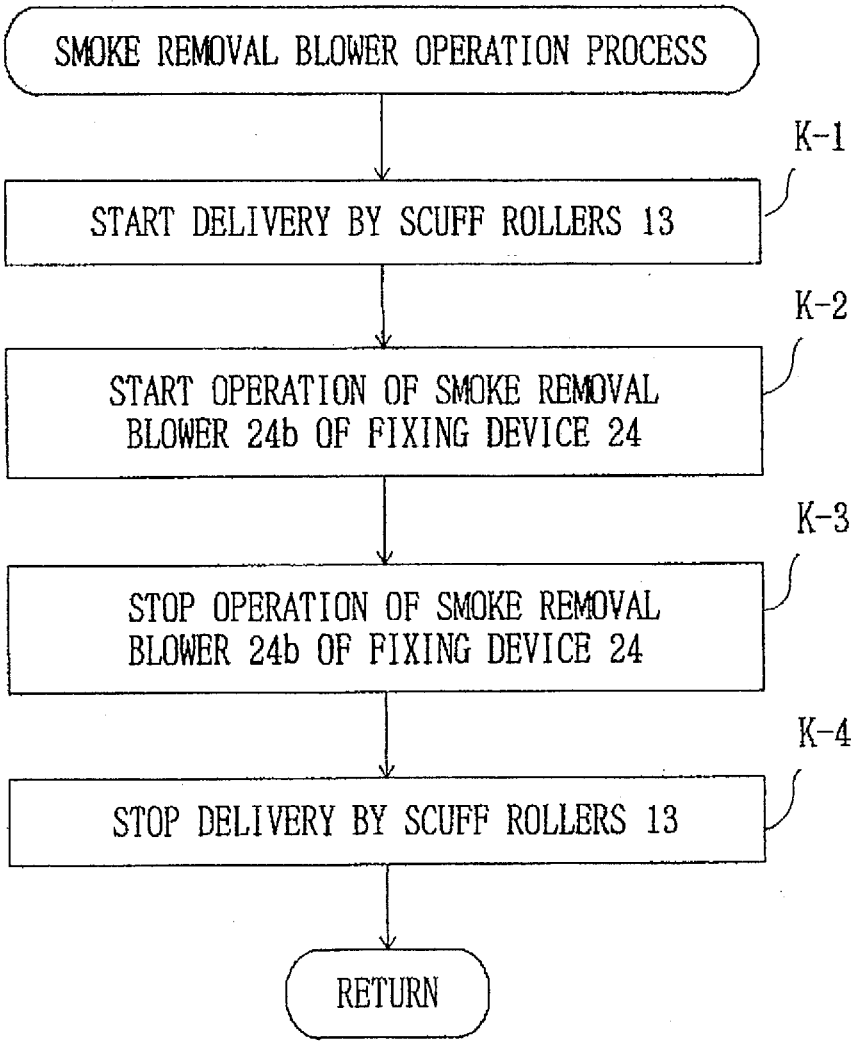
Figure 18:
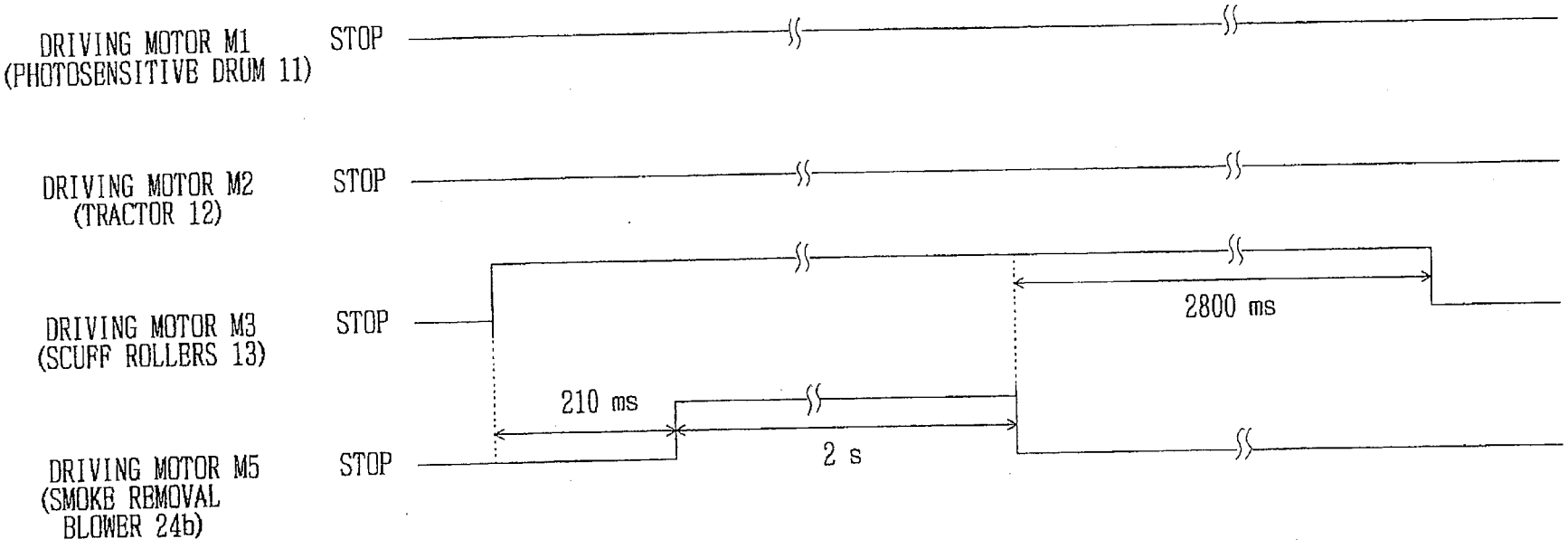

[Smoke removal blower operation process routine (Step K)—see FIGS. 10 and 18]

Before starting this routine, the driving motor M1 for rotating the photosensitive drum 11, the driving motor M2 for driving the tractor 12 and the driving motor M3 for rotating the delivery roller 13*a* of the scuff rollers 13 are all stopped and the transfer device 17 is positioned at the remote position in relation to the photosensitive drum 11.

In such a condition, the driving motor M3 for rotating the delivery roller 13*a* of the scuff rollers 13 is driven through the driver circuit 34, such that the scuff rollers 13 deliver the continuous paper 3 in the delivery direction b at a speed of 89 mm/s (Step K-1). Since the tractor 12 is stopped, the continuous paper 3 is pulled by the scuff roller 13 which have a delivery speed of 89 mm/s, so that tension is imparted to the continuous paper 3, thereby eliminating deflection of the continuous paper 3 between the tractor 12 and the scuff rollers 13.

After an elapse of 210 ms since the delivery of the continuous paper 3 by the scuff rollers 13 started, the driving motor M5 for operating the smoke removal blower 24*b* of the fixing device 24 is actuated through the driver circuit 36 (Step K-2). After an elapse of a preset time (=2 s) required for removing smoke and odor with the smoke removal blower 24*b* since the smoke removal blower 24*b* was actuated, the driving motor M5 for operating the smoke removal blower 24*b* is stopped (Step K-3). After the smoke removal blower 24*b* has completely lost its suction force after stopping the driving motor M5 (2,800 ms), the driving motor M3 for rotating the delivery roller 13*a* of the scuff rollers 13 is stopped, thereby stopping the delivery operation of the scuff rollers 13 (Step K-4).

During the operation of the smoke removal blower 24*b* for removing smoke and odor caused by heat fusing with the flash lamp 24*a* of the fixing device 24, the continuous paper 3 is pulled by the scuff rollers 13 and tension is imparted to the continuous paper 3 so that deflection of the continuous paper 3 caused by the suction force of the smoke removal blower 24*b* is eliminated.

Figure 11:
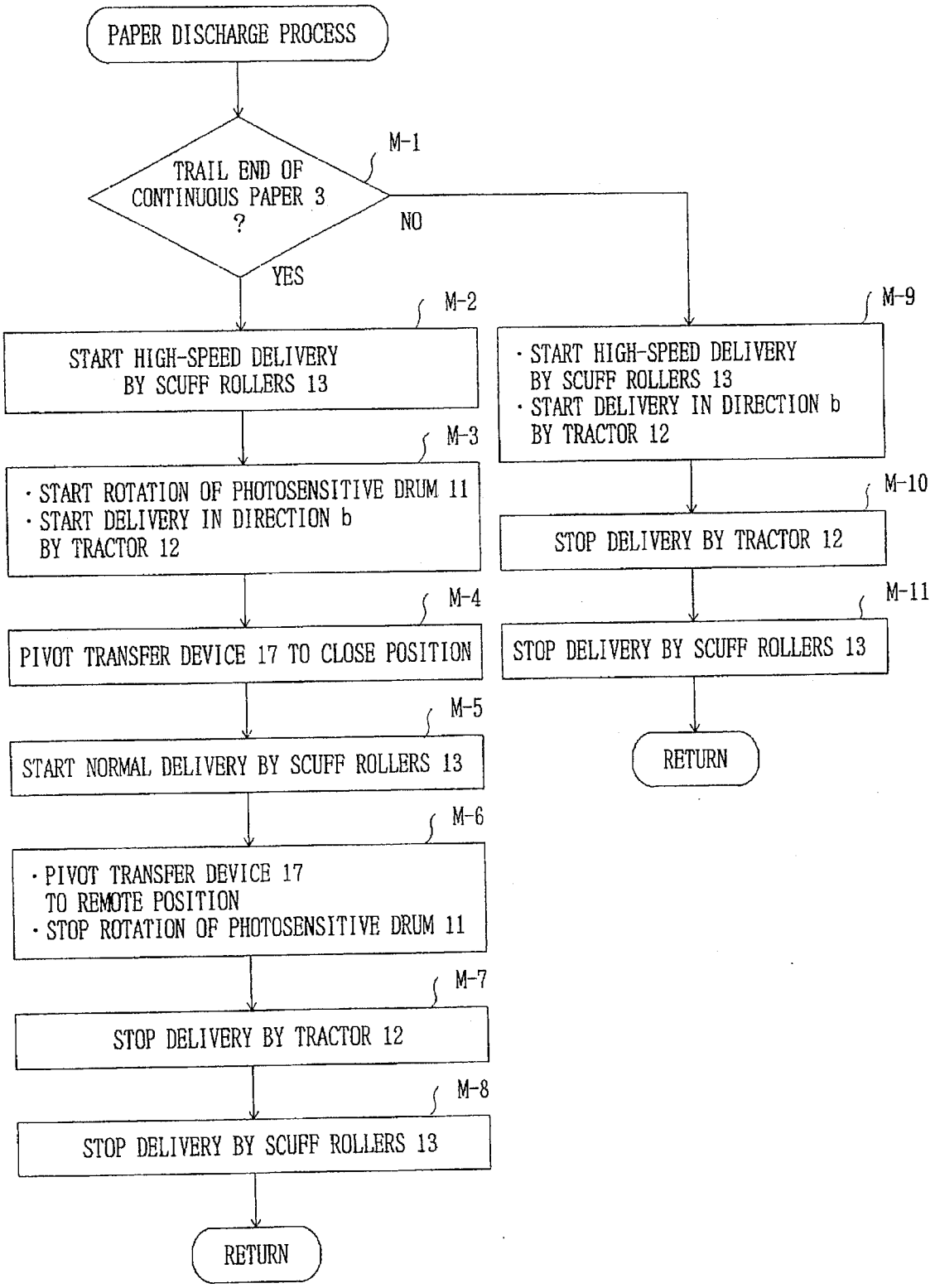
Figure 19:
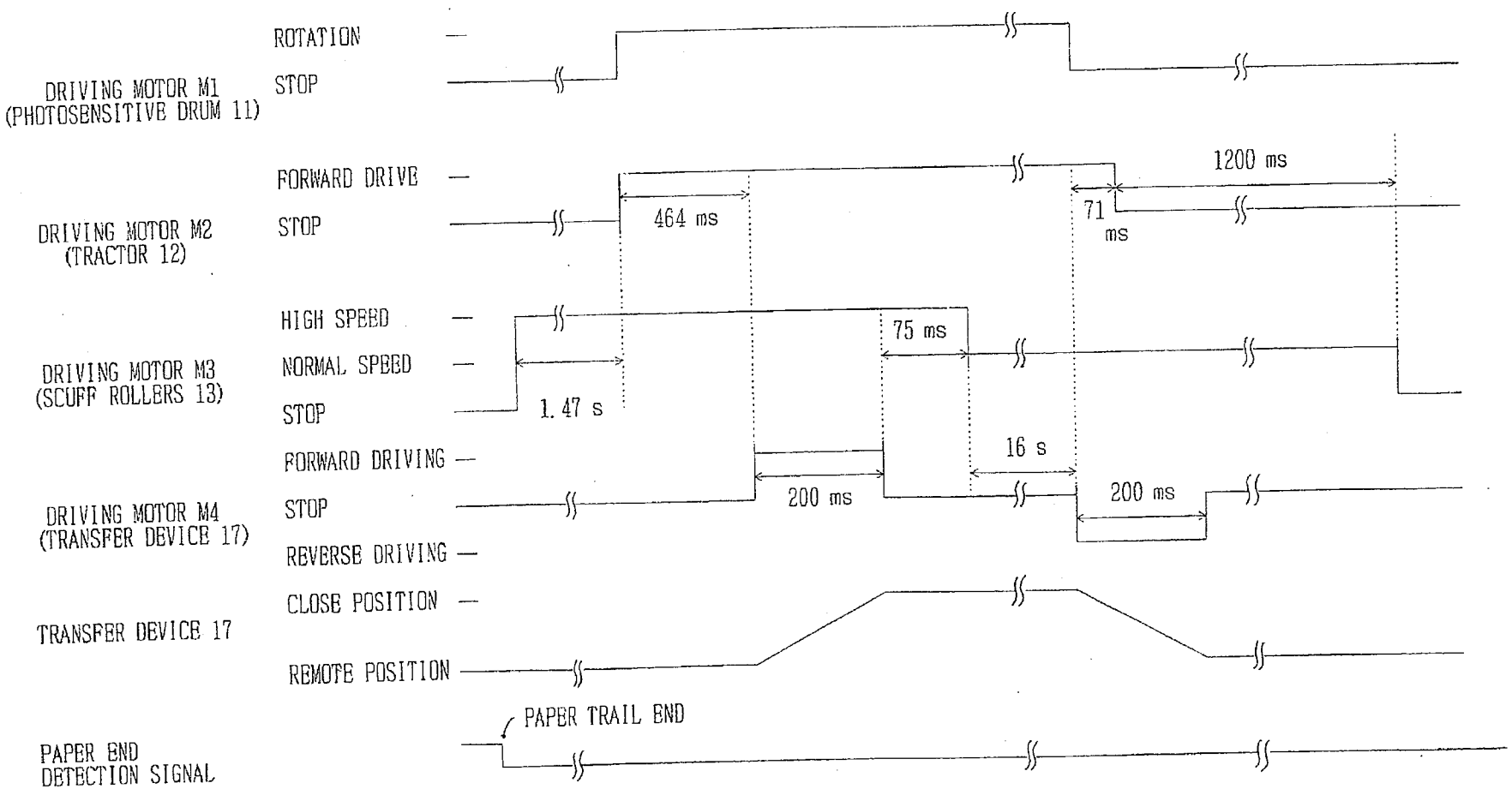
Figure 20:
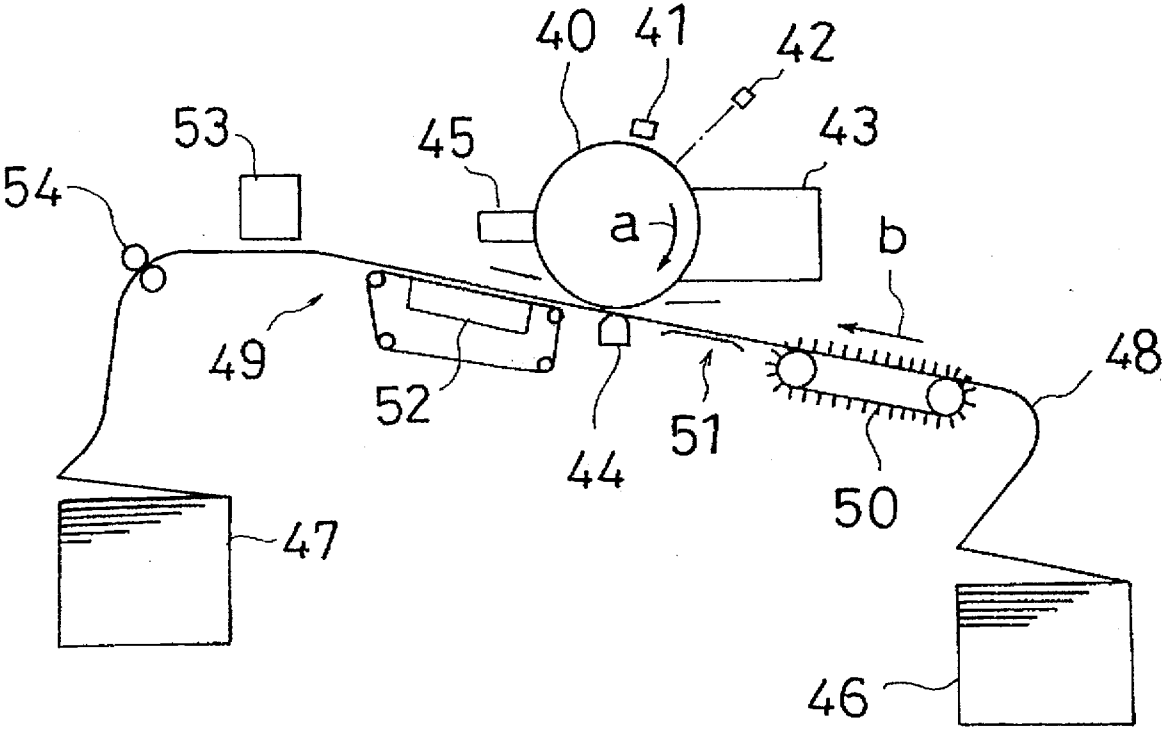
FIG. 20 is a diagrammatic illustration of a conventional printer.

[Paper discharge process routine (Step M)—see FIGS. 11 and 19]

Before starting this routine, the driving motor M1 for rotating the photosensitive drum 11, the driving motor M2 for driving the tractor 12 and the driving motor M3 for rotating the delivery roller 13*a* of the scuff rollers 13 are all stopped and the transfer device 17 is positioned at the remote position.

In such a condition, a check is made to determine if the trail end of the continuous paper 3 has been detected based on the paper end detection signal input through the A/D convertor 30 (Step M-1). If so, the driving motor M3 for rotating the delivery roller 13*a* of the scuff rollers 13 is driven through the driver circuit 34 such that the scuff rollers 13 deliver the continuous paper 3 in the delivery direction b at a high speed of 93 mm/s (Step M-2).

Figure 17:
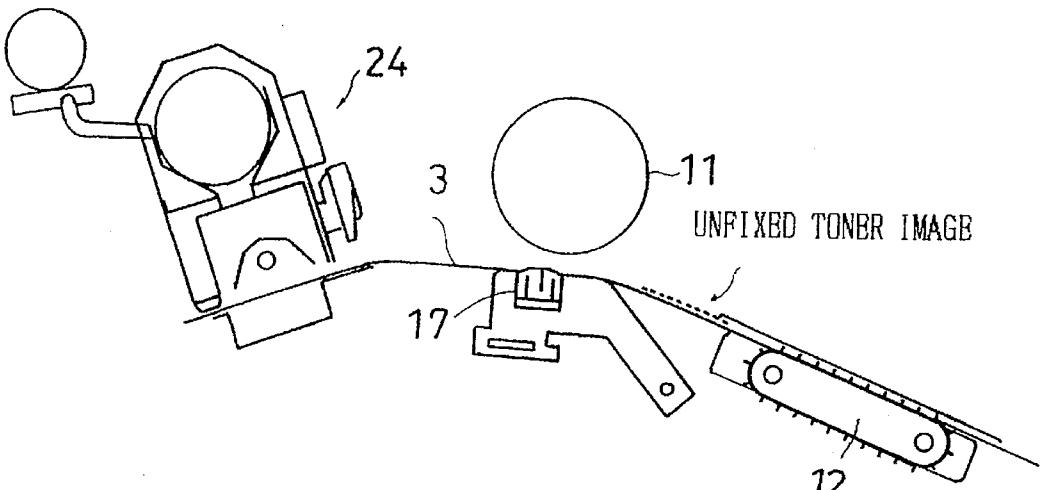
Figure 17:
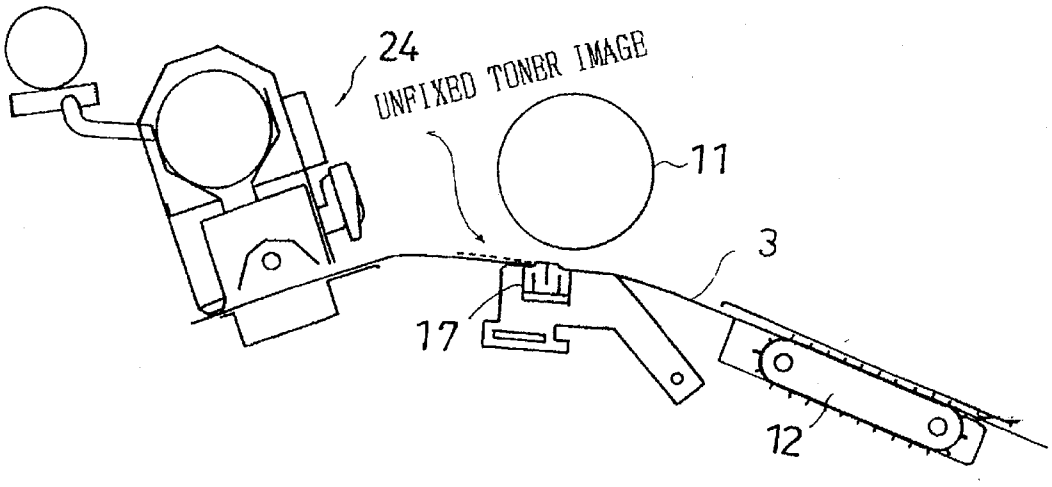

After an elapse of 1.47 s since the start of actuation of the driving motor M3, the driving motor M1 for rotating the photosensitive drum 11 is driven through the driver circuit 32 and the driving motor M2 for driving the tractor 12 is forwardly driven through the driver circuit 33 such that the continuous paper 3 is delivered in the delivery direction b at a speed of 89 mm/s (Step M-3). After an elapse of 464 ms since the start of driving of the driving motors M1 and M2, which means, between the time when the continuous paper 3 has passed the photosensitive drum 11, being delivered in the delivery direction b and the time when the transferred, unfixed toner image on the continuous paper 3 has reached the fixing device 24 (the continuous paper 3 in this state is shown in FIG. 17(B)), and which means, after the continuous paper 3 has been delivered by ½ inch in the delivery direction b, the driving motor M4 is forwardly driven through the driver circuit 35 to pivot the transfer device 17 to the close position in relation to the photosensitive drum 11 (Step M-4). After an elapse of 200 ms since the start of pivot of the transfer device 17 to the close position, the pivot is completed and the transfer device 17 is positioned at the close position. After 75 ms has elapsed since the transfer device 17 was positioned at the close position, the driving motor M3 for rotating the delivery roller 13*a* of the scuff rollers 13 is driven through the driver circuit 34 such that the delivery speed of the scuff rollers 13 delivering the continuous paper 3 in the deliver direction b is changed from 93 mm/s (high speed) to 89 mm/s (normal speed) (Step M-5).

Positioning of the transfer device 17 in the close position in relation to the photosensitive drum 11 allows the continuous paper 3 to be held between the photosensitive drum 11 and the transfer device 17 so that the trail end of the continuous paper 3 does not flutter after it has passed the tractor 12. This prevents the unfixed toner image transferred onto the continuous paper 3 from being disturbed and the toner of the unfixed toner image from sticking to other devices. In this case, a specified current is not supplied to the corona wire 17*a* of the transfer device 17 and the unfixed toner image transferred onto the continuous paper 3 is thermally fused by the flash lamp 24*a* of the fixing device 24 when the scuff rollers 13 have a normal delivery speed of 89 mm/s.

After an elapse of a preset time (16 s) required for discharging the continuous paper 3 (for discharging five sheets of 11-inch paper in this embodiment) since the driving motor M3 was driven to start paper delivery at a normal speed of 89 mm/s by the scuff rollers 13, the driving motor M4 for pivoting the transfer device 17 is reversely driven through the driver circuit 35, thereby pivoting the transfer device 17 to the remote position in relation to the photosensitive drum 11 and the driving motor M1 for rotating the photosensitive drum 11 is stopped (Step M-6). After an elapse of 71 ms since the start of pivoting of the transfer device 17 to the remote position, the driving motor M2 for driving the tractor 12 is stopped. After an elapse of 200 ms since the start of pivoting of the transfer device 17 to the remote position, that is, after the transfer device 17 has been positioned at the remote position, being completely pivoted, the driving motor M4 for pivoting the transfer device 17 is stopped (Step M-7). After an elapse of 1200 ms since the stop of the driving motor M2 for the tractor 12, the driving motor M3 for rotating the delivery roller 13*a* of the scuff rollers 13 is stopped, thereby stopping the delivery operation of the scuff rollers 13 (Step M-8).

If it is determined based on the paper end detection signal which has been input through the A/D convertor 30 that the trail end of the continuous paper 3 has not been detected, the driving motor M3 for rotating the delivery roller 13*a* of the scuff rollers 13 is driven through the driver circuit 34 such that the scuff rollers 13 deliver the continuous paper 3 in the delivery direction b at a high speed of 93 mm/s. The driving motor M2 for the tractor 12 is forwardly driven through the driver circuit 33 to deliver the continuous paper 3 in the delivery direction b at a speed of 89 mm/s (Step M-9). After an elapse of a preset time (21 s) required for discharging the continuous paper 3 (discharging seven sheets of 11-inch paper in this embodiment) since the driving motor M2 was actuated, the driving motor M2 for the tractor 12 is stopped (Step M-10). Then, after an elapse of 600 ms since the stop of the driving motor M2 for the tractor 12, the driving motor M3 for rotating the delivery roller 13*a* of the scuff rollers 13 is stopped, thereby stopping the delivery operation of the scuff rollers 13 (Step M-11).

Although heat fusing of a toner image transferred onto the continuous paper is performed with the flash lamp of the fixing device in the foregoing embodiment, it could be performed by the use of heating rollers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer, comprising:

(a) tone image carrying means capable of carrying a toner image formed from electrically charged toner, disposed beside the substantially mid-point of a delivery path for continuous paper;

(b) first delivery means for delivering the continuous paper such that slippage of the continuous paper with respect to the delivery speed of the first delivery means cannot occur when the continuous paper is delivered in a delivery direction, the means being disposed on the upstream side in the delivery direction with respect to the toner image carrying means which is disposed beside the substantially mid-point of the delivery path;

(c) second delivery means for delivering the continuous paper such that slippage of the continuous paper with respect to the delivery speed of the second delivery means can occur when the continuous paper is delivered in the delivery direction, the means being disposed on the downstream side in the delivery direction with respect to the toner image carrying means which is disposed beside the substantially mid-point of the delivery path;

(d) transfer means for transferring the toner image carried by the toner image carrying means onto the continuous paper, disposed so as to face the toner image carrying means with the delivery path between; and (e) paper delivery control means for controlling the delivery speeds of the first delivery means and the second delivery means such that the delivery speed of the second delivery means in the delivery direction is greater then the delivery speed of the first delivery means in the delivery direction which includes zero, whereby tension is imparted to the continuous paper between the first and second delivery means;

further comprising fixing means for fixing the toner image which has been transferred from the toner image carrying means onto the continuous paper by the transfer means, the fixing means being disposed between the toner image carrying means disposed beside the substantially mid-point of the delivery path and the second delivery means;

wherein the paper delivery control means controls the delivery speed of the second delivery means to exceed zero, when the delivery speed of the first delivery means is zero and a smoke removal blower provided in the fixing means is operated.

2. A printer, comprising:

(a) toner image carrying means capable of carrying a toner image formed from electrically charged toner, disposed beside the substantially mid-point of a delivery path for continuous paper;

(b) first delivery means for delivering the continuous paper such that slippage of the continuous paper with respect to the delivery speed of the first delivery means cannot occur when the continuous paper is delivered in a delivery direction, the means being disposed on the upstream side in the delivery direction with respect to the toner image carrying means which is disposed beside the substantially mid-point of the delivery path;

(c) second delivery means for delivering the continuous paper such that slippage of the continuous paper with respect to the delivery speed of the second delivery means can occur when the continuous paper is delivered in the delivery direction, the means being disposed on the downstream side in the delivery direction with respect to the toner image carrying means which is disposed beside the substantially mid-point of the delivery path;

(d) transfer means for transferring the toner image carried by the toner image carrying means onto the continuous paper, disposed so as to face the toner image carrying means with the delivery path between; and (e) paper delivery control means for controlling the delivery speeds of the first delivery means and the second delivery means such that the delivery speed of the second delivery means in the delivery direction is greater than the delivery speed of the first delivery means in the delivery direction which includes zero, whereby tension is imparted to the continuous paper between the first and second delivery means;

wherein the toner image carrying means rotates in such a direction that the carried toner image is transferred onto the continuous paper being delivered in the delivery direction in the delivery path;

wherein the paper delivery control means controls the delivery speed of the second delivery means to exceed zero, when the delivery speed of the first delivery means is zero and the toner image carrying means is actuated to rotate.

3. A printer, comprising:

(a) toner image carrying means which is disposed beside the substantially mid-point point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery means for delivering a continuous paper toward the toner image carrying means, disposed on the upstream side in the delivery direction with respect to the toner image carrying means which is disposed beside the substantially mid-point of the delivery path;

(c) second delivery means for delivering the continuous paper from the toner image carrying means, disposed on the downstream side in the delivery direction with respect to the toner image carrying means which disposed beside the substantially mid-point of the delivery path;

(d) transfer means which is disposed so as to face the toner image carrying means with the delivery path between, and which is movable between a position close to the toner image carrying means where the toner image carried by the toner image carrying means is transferred onto the continuous paper and a position remote from the toner image carrying means; and (e) paper delivery control means for controlling the toner image carrying means to start rotation and the transfer means to be positioned at the close position in relation to the toner image carrying means by the time the trail end of the continuous paper has been delivered by the first delivery means at the latest;

further comprising paper trail end detector means for detecting the trail end of the continuous paper, disposed on the upstream side of the first delivery means in the delivery direction, wherein the paper delivery control means controls the toner image carrying means to start rotation and the transfer means to be positioned at the close position in relation to the toner image carrying means, based on detection of the trail end of the continuous paper by the paper trail end detector means.

4. A printer, comprising:

(a) toner image carrying means which is disposed beside the substantially mid-point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery meant for delivering the continuous paper toward the toner image carrying means, disposed on the upstream side in the delivery direction with respect to the toner image carrying means which is disposed beside the substantially mid-point of the delivery path;

(c) second delivery means for delivering the continuous paper from the toner image carrying direction, disposed on the down-stream side in the delivery direction with respect to the toner image carrying means which is disposed beside the substantially mid-point of the delivery path;

(d) transfer means for transferring the toner image carried by the toner image carrying means onto the continuous paper, disposed so as to face the other image carrying means with the delivery path between; and (e) paper delivery control means for controlling the toner image carrying means to start rotation by the time the leading end of the continuous paper has been delivered by the first deliver means and has reached the toner image carrying means at the latest;

wherein the delivery path including at least the positions of the first and second delivery means and running between the first and second delivery means is angled such that the vertex area of the angled delivery path is positioned under the toner image carrying means and in the vicinity of the transfer means which is disposed to face the toner image carrying means with the delivery path between;

wherein the transfer means is movable between a position close to the toner image carrying means and a position remote from the toner image carrying means and wherein the paper delivery control means controls the transfer means to be positioned at the remote position in relation to the toner image carrying mean, by the time the leading end of the continuous paper has reached the toner image carrying means at the latest.

5. A printer comprising:

(a) toner image carrying means which is disposed beside the substantially mid-point of a delivery path for continuous paper, which is capable of carrying a toner image formed from electrically charged toner, and which rotates in such a direction that the carried toner image is transferred onto the continuous paper being delivered in a delivery direction in the delivery path;

(b) first delivery means for delivering the continuous paper such that slippage of the continuous paper with respect to the delivery speed of the first delivery means cannot occur when the continuous paper is delivered in the delivery direction, the means being disposed on the upstream side in the delivery direction with respect to the toner image carrying means which is disposed beside the substantially mid-point of the delivery path;

(c) second delivery means for delivering the continuous paper such that slippage of the continuous paper with respect to the delivery speed of the second delivery means can occur when the continuous paper is delivered in the delivery direction, the means being disposed on the downstream side in the delivery direction with respect to the toner image carrying means which is disposed beside the substantially mid-point of the delivery path;

(d) transfer means which is disposed so as to face the toner image carrying means with the delivery path between and which is movable between a position close to the toner image carrying means where the toner image carried by the toner image carrying means is transferred onto the continuous paper and a position remote from the toner image carrying means;

(e) fixing means for fixing the toner image which has been transferred onto the continuous paper from the toner image carrying means by the transfer means, disposed between the second delivery means and the toner image carrying means disposed beside the substantially mid-point of the delivery path; and (f) paper delivery control means for controlling the delivery speeds of the first delivery means and the second delivery means so as to cause a relative speed difference between the first and second delivery means thereby to impart tension to the continuous paper between the first and second delivery means; and for controlling the transfer means to be positioned at the close position in relation to the rotating toner image carrying means, between the time when the unfixed toner image has passed the toner image carrying means and the time when the unfixed toner image has reached the fixing means, during which time the continuous paper, which bears the unfixed toner image and has been once delivered by a specified distance in a direction opposite to the delivery direction with the transfer means positioned at the remote position with respect to the toner image carrying means upon completion of printing, is again delivered in the delivery direction.

6. The printer as claimed in claim 5, wherein the paper delivery control means controls the transfer means to be positioned at the close position in relation to the rotating toner image carrying means when the trail end of the continuous paper is delivered by the first delivery means.

* * * * *